US009946204B2

(12) United States Patent
Takahashi

(10) Patent No.: US 9,946,204 B2
(45) Date of Patent: Apr. 17, 2018

(54) IMAGE FORMING APPARATUS, CONTROL METHOD, AND STORAGE MEDIUM

(71) Applicant: CANON KABUSHIKI KAISHA, Tokyo (JP)

(72) Inventor: Shuhei Takahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/470,674

(22) Filed: Aug. 27, 2014

(65) Prior Publication Data

US 2015/0063839 A1 Mar. 5, 2015

(30) Foreign Application Priority Data

Aug. 30, 2013 (JP) ..... 2013-180000

(51) Int. Cl.
*G03G 15/00* (2006.01)
*G03G 15/08* (2006.01)

(52) U.S. Cl.
CPC ..... *G03G 15/50* (2013.01); *G03G 15/0856* (2013.01); *G03G 15/556* (2013.01)

(58) Field of Classification Search
CPC ..... G03G 15/0824; G03G 15/0831; G03G 15/553; G03G 15/556
USPC ..... 399/27, 59, 63
See application file for complete search history.

(56) References Cited

U.S. PATENT DOCUMENTS

| | | | | |
|---|---|---|---|---|
| 6,347,198 | B1 | 2/2002 | Yamamoto | |
| 2002/0037173 | A1 | 3/2002 | Kakeshita | |
| 2002/0141765 | A1 | 10/2002 | Phillips | |
| 2004/0218936 | A1 | 11/2004 | Dougherty | |
| 2006/0159473 | A1 | 7/2006 | An | |
| 2007/0058996 | A1* | 3/2007 | Sakita et al. | 399/27 |
| 2009/0297177 | A1 | 12/2009 | Shimizu | |
| 2013/0266329 | A1* | 10/2013 | Otani | G03G 15/0824 399/27 |

FOREIGN PATENT DOCUMENTS

| | | | |
|---|---|---|---|
| CN | 102236295 | A | 11/2011 |
| CN | 102591174 | A | 7/2012 |
| EP | 1281524 | A2 | 2/2003 |
| EP | 1394628 | A2 | 3/2004 |
| JP | 2001-183898 | A | 7/2001 |
| JP | 2002-174929 | A | 6/2002 |
| JP | 2002-372848 | A | 12/2002 |
| JP | 2006-343621 | A | 12/2006 |
| JP | 2011-126021 | A | 6/2011 |

* cited by examiner

*Primary Examiner* — Walter L Lindsay, Jr.
*Assistant Examiner* — Jessica L Eley
(74) *Attorney, Agent, or Firm* — Canon USA Inc., IP Division

(57) ABSTRACT

Control is performed so that a current value gradually shifts, corresponding to a sensor value. More specifically, when a predicted value of a remaining toner amount is calculated, processing for correcting a consumed toner amount corresponding to the sensor value is performed for a consumed toner amount.

12 Claims, 23 Drawing Sheets

IMAGE FORMING APPARATUS, CONTROL METHOD, AND STORAGE MEDIUM

BACKGROUND OF THE INVENTION

Field of the Invention

The present invention relates to an image forming apparatus, a control method, and a storage medium.

Description of the Related Art

An image forming apparatus performs image formation on a sheet using a recording material such as toner. Generally, the recording material is contained in a containing unit such as a cartridge. Some image forming apparatuses detect a remaining amount of a recording material remaining in a containing unit and display its value on a display unit such as a user interface (UI).

Conventionally, a sensor has been provided in some image forming apparatuses which directly displays a value detected as a remaining amount of a recording material. Due to cost sensors may be used that cannot make an accurate detection until the remaining amount is reduced to some extent. In this case, the sensor detects the remaining amount of the recording material in discrete units, for example, 100%, 20%, and 0%. As a result, the remaining amount of the recording material is discretely displayed, for example, 100%, 20%, and 0% also on a display unit.

On the other hand, there is a technique for continuously displaying a remaining amount of a recording material in a display unit while using a sensor for discretely detecting the remaining amount (Japanese Patent Application Laid-Open No. 2006-343621). When an image is formed, a predicted value of a remaining toner amount is calculated based on a dot count value of raster data, and is displayed as a current value of a remaining toner amount. When a sensor value of the remaining toner amount is acquired from the sensor, the current value is updated with the sensor value.

When the sensor value is acquired, a user may be confused when display of the remaining toner amount transitions if a difference between the current value and the sensor value is large. If the sensor value is smaller than the current value, for example, the user may wonder why the remaining toner amount has rapidly decreased, although only a small amount of toner has been consumed when the current value is updated with the sensor value. Conversely, if the sensor value is larger than the current value, the user may wonder why the remaining toner amount stands still for a while, despite toner being consumed, if the current value is not updated until the sensor value overtakes the current value.

SUMMARY OF THE INVENTION

The present invention is directed to preventing confusion of a user caused by the transition of a remaining toner amount on a display, when a sensor value is acquired, even if a difference between a current value and the sensor value is large.

According to an aspect of the present disclosure, an image forming apparatus includes a containing unit configured to contain a recording material used for printing, a sensor configured to detect an amount of the recording material remaining in the containing unit, a printing unit configured to perform printing, a calculation unit configured to calculate a consumed amount of the recording material consumed in the printing when the printing unit performs the printing, a correction unit configured to correct the consumed amount of the recording material calculated by the calculation unit, a prediction unit configured to predict the remaining amount of the recording material remaining in the containing unit based on the consumed amount of the recording material corrected by the correction unit, and a storage unit configured to store the remaining amount of the recording material predicted by the prediction unit, wherein the correction unit adds a predetermined amount to the consumed amount of the recording material calculated by the calculation unit to correct the consumed amount of the recording material calculated by the calculation unit when the remaining amount of the recording material stored in the storage unit is larger than the remaining amount of the recording material detected by the sensor.

Further features of the present invention will become apparent from the following description of exemplary embodiments with reference to the attached drawings. Each of the embodiments of the present invention described below can be implemented solely or as a combination of a plurality of the embodiments or features thereof where necessary or where the combination of elements or features from individual embodiments in a single embodiment is beneficial.

DESCRIPTION OF THE EMBODIMENTS

Various exemplary embodiments, features, and aspects of the invention will be described in detail below with reference to the drawings.

Figure 1:
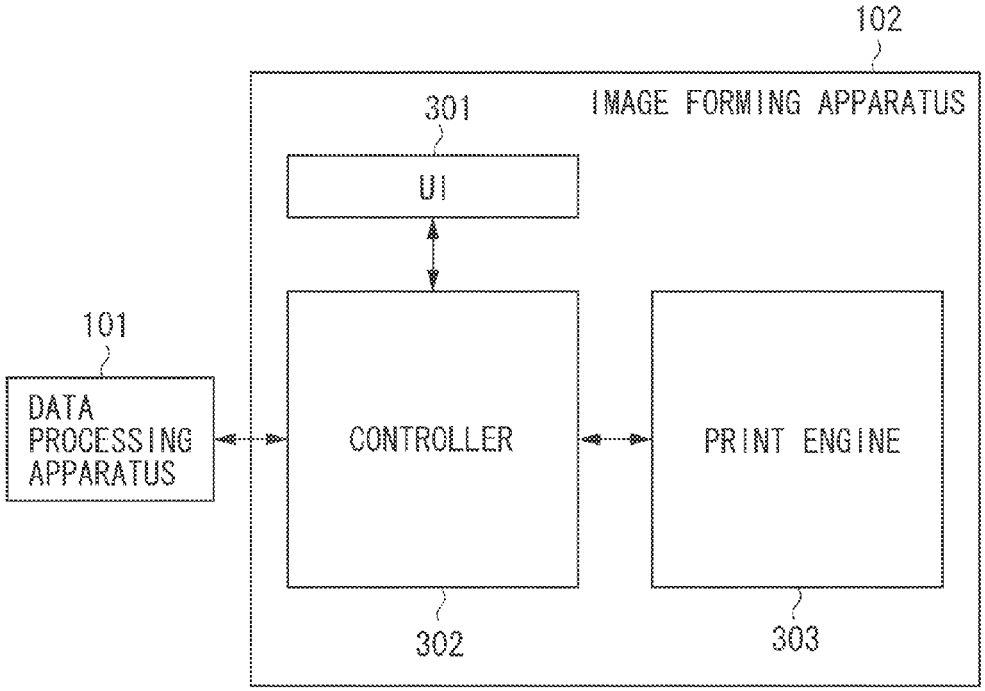
FIG. 1 is a block diagram illustrating a configuration of an image forming apparatus.

FIG. 1 is a block diagram illustrating a configuration of an image forming apparatus.

A data processing apparatus 101 (e.g., a personal computer (PC)) generates image data, and transmits the generated image data to an image forming apparatus 102.

The image forming apparatus 102 (e.g., a laser printer) receives the image data from the data processing apparatus 101, and forms an image on a sheet based on the image data. The image forming apparatus 102 may be a multifunction peripheral having a scanner function and a facsimile (FAX) function.

A UI 301 includes a display unit that presents various information to a user, and an operation unit that accepts various operations from the user. A current value of a remaining toner amount, described below, is displayed on the display unit. The current value of the remaining toner amount may be transmitted to an external apparatus such as the data processing apparatus 101 via an external interface (I/F) and displayed on a display unit in the external apparatus such as the data processing apparatus 101.

A controller 302 generates bit map data based on page description language (PDL) data, and transmits the generated bit map data to a print engine 303. Details of the controller 302 will be described below with reference to FIG. 2.

The print engine 303 performs image formation on a sheet using toner in an electrophotographic system based on the bit map data received from the controller 302. A method for the image formation may be other than the electrophotographic method, e.g., an inkjet method. While a recording agent in the electrophotographic method is toner in this case, a recording agent in the inkjet method is ink.

The controller 302 and the print engine 303 are separated from each other, but may be integrated with each other.

Figure 2:
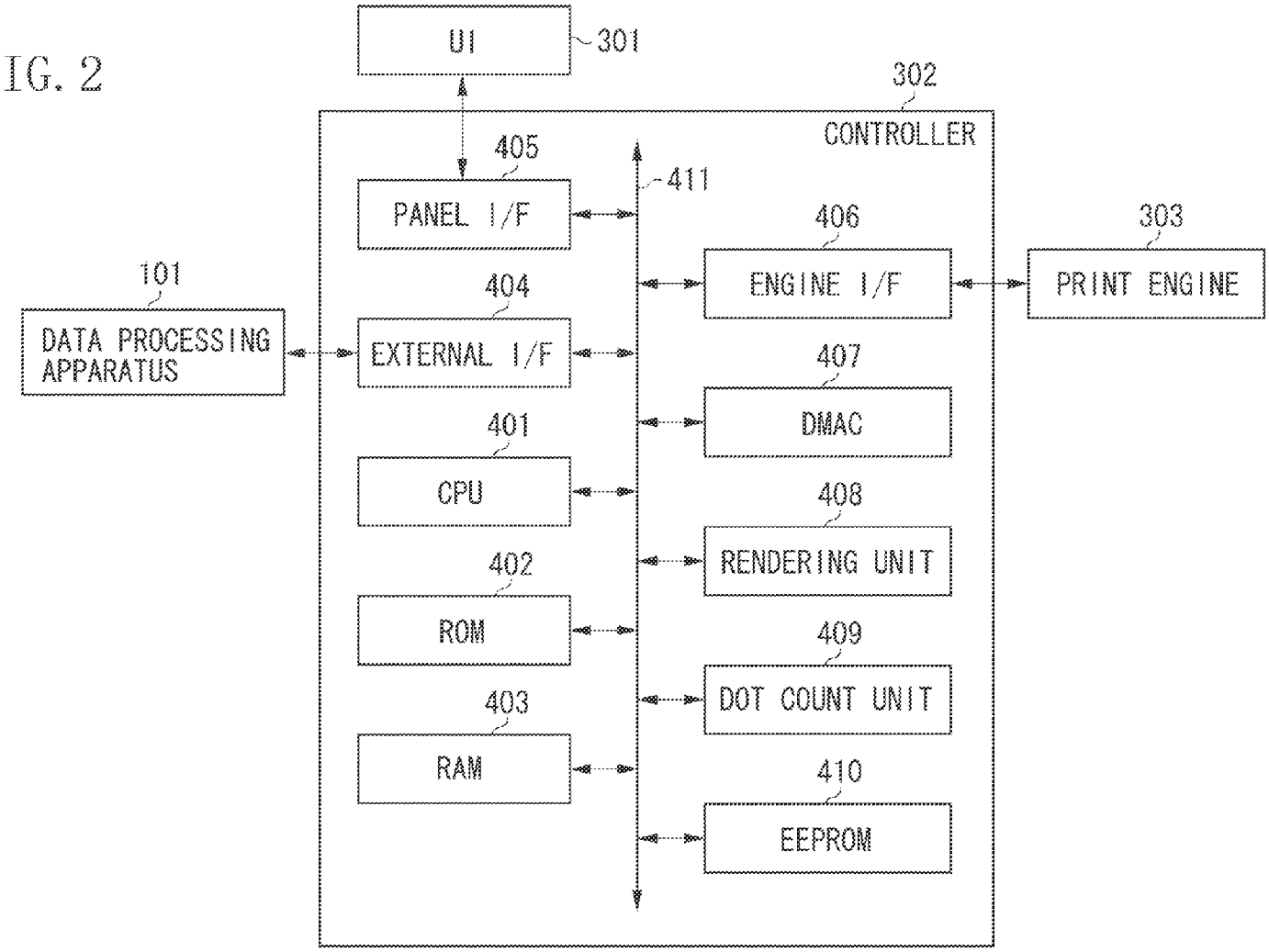
FIG. 2 is a block diagram illustrating a configuration of a controller.

FIG. 2 is a block diagram illustrating a configuration of the controller 302.

A central processing unit (CPU) 401 expands a program stored in a read-only memory (ROM) 402 into a random access memory (RAM) 403, and expands the program to control the image forming apparatus 102. The CPU 401 calculates a remaining toner amount based on a predicted value of a consumed toner amount converted from the number of dots counted by a dot count unit 409 and a sensor value of the remaining toner amount informed from the print engine 303. The CPU 401 displays the calculated remaining toner amount on a UI 301 via a panel I/F 405, and notifies the data processing apparatus 101 of the remaining toner amount via an external I/F 404.

The ROM 402 stores the program to be executed by the CPU 401.

The RAM 403 stores the program expanded from the ROM 402. The RAM 403 stores PDL data, intermediate data generated by interpreting the PDL data, bit map data generated by rendering the intermediate data, and various types of temporary processing status and log information required for other processing.

The external I/F 404 connects the data processing apparatus 101 and the controller 302, and relays data communication therebetween, i.e., transmission and receiving of data.

The panel I/F 405 connects the UI 301 and the controller 302, and relays data transmission therebetween, i.e., transmits and receives data.

An engine I/F 406 connects the print engine 303 and the controller 302, and relays data communication therebetween, i.e., transmits and receives data.

A direct memory access controller (DMAC) 407 receives an instruction from the CPU 401, and performs data access to the RAM 403, i.e., writes and reads data to and from the RAM 403.

A rendering unit 408 rasterizes the intermediate data into bit map data.

The dot count unit 409 counts, among dots included in the bit map data after the rasterization, the number of the dots for which toner is consumed when the image formation is performed. More specifically, the number of dots having a color other than white is counted. For example, the number of dots corresponds to that of black (K) in the case of monochrome printing, and corresponds to that of either yellow (Y), magenta (M), cyan (C), or black (K) in the case of color printing. The CPU 401 or the rendering unit 408 may count the number of dots.

An electrically erasable and programmable read only memory (EEPROM) 410 stores setting information about the image forming apparatus 102.

A bus 411 connects the components in the controller 302 to one another.

Figure 3:
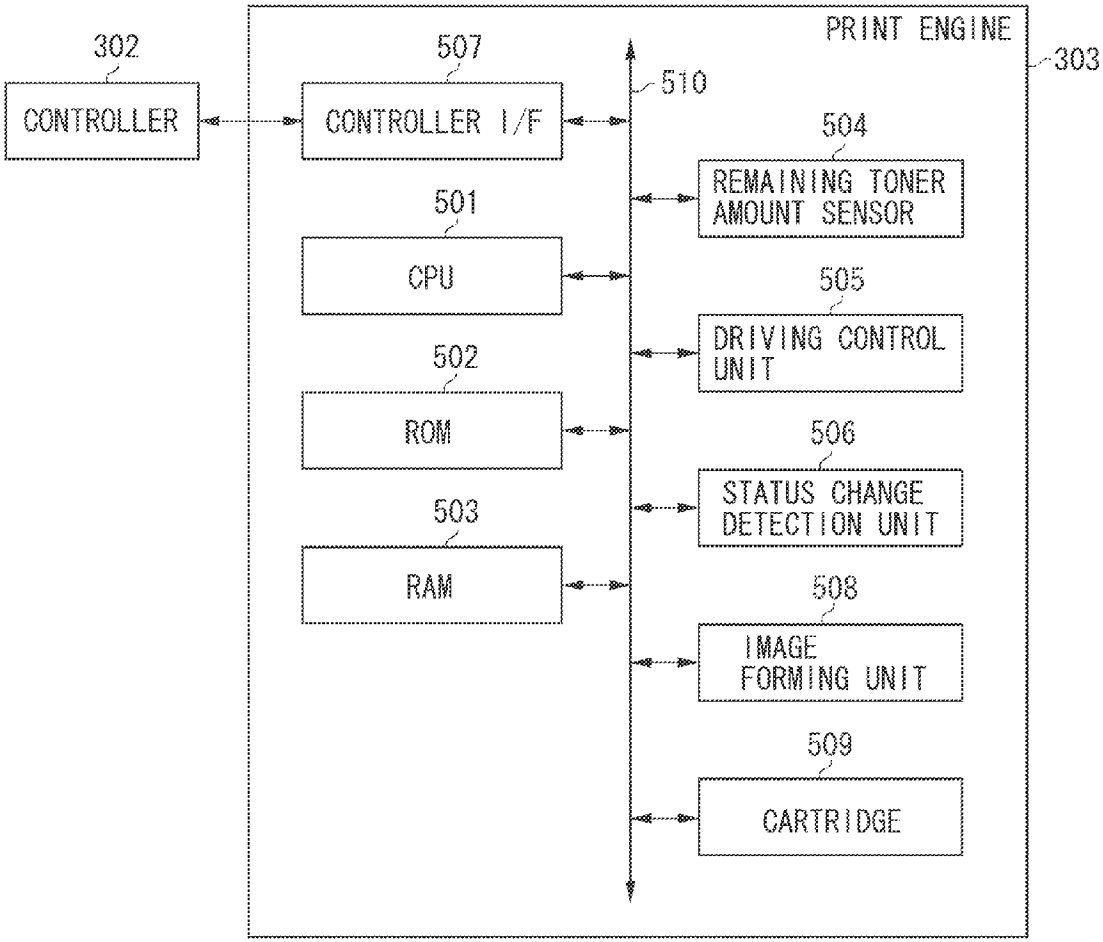
FIG. 3 is a block diagram illustrating a configuration of a print engine.

FIG. 3 is a block diagram illustrating a configuration of the print engine 303.

A CPU 501 expands a program stored in a ROM 502 into a RAM 503, and executes the program, to control the print engine 303.

The ROM 502 stores the program to be executed by the CPU 501.

The RAM 503 stores the program expands from the ROM 502.

A remaining toner amount sensor 504 measures a remaining toner amount included in a cartridge 509. A system for detecting the remaining toner amount in a sensor includes a magnetic permeability detection system, a magnet system, a piezoelectric vibration system, and a transmissive light system. When the remaining toner amount has reached a predetermined value such as 20% or 0%, for example, the sensor detects the value as a sensor value. More specifically, the value is detected as 100% when the remaining toner amount is 100% to 21%, 20% when the remaining toner amount is 20% to 1%, and 0% when the remaining toner amount is 0%. The sensor may be provided in the cartridge 509.

A driving control unit 505 drives various types of motors required when an image forming unit 508 forms an image.

A status change detection unit 506 detects a status change such as a jam or cover open in the image forming apparatus 102. The status change detection unit 506 also detects replacement of the cartridge 509. The CPU 501 may detect the status change.

A controller I/F 507 connects the controller 302 and the print engine 303, and relays data communication therebetween, i.e., transmission and receiving of data.

The image forming unit 508 performs image formation on a sheet using the toner in the electrophotographic system based on the bit map data received from the controller 302.

The cartridge 509 is a process cartridge, which can be mounted on the image forming apparatus 102, as a containing unit that contains toner, and stores toner to be used when the image forming unit 508 performs the image formation. The cartridge 509 includes a nonvolatile storage medium which stores cartridge information. The cartridge information includes information indicating whether the cartridge 509 is new, color information indicating a color of the cartridge 509, and remaining toner amount information indicating a present remaining toner amount in the cartridge 509. The cartridge 509 is connected to a bus 519, but may be connected to the CPU 501 via a dedicated line.

The bus 510 connects the components in the print engine 303.

Figure 4:
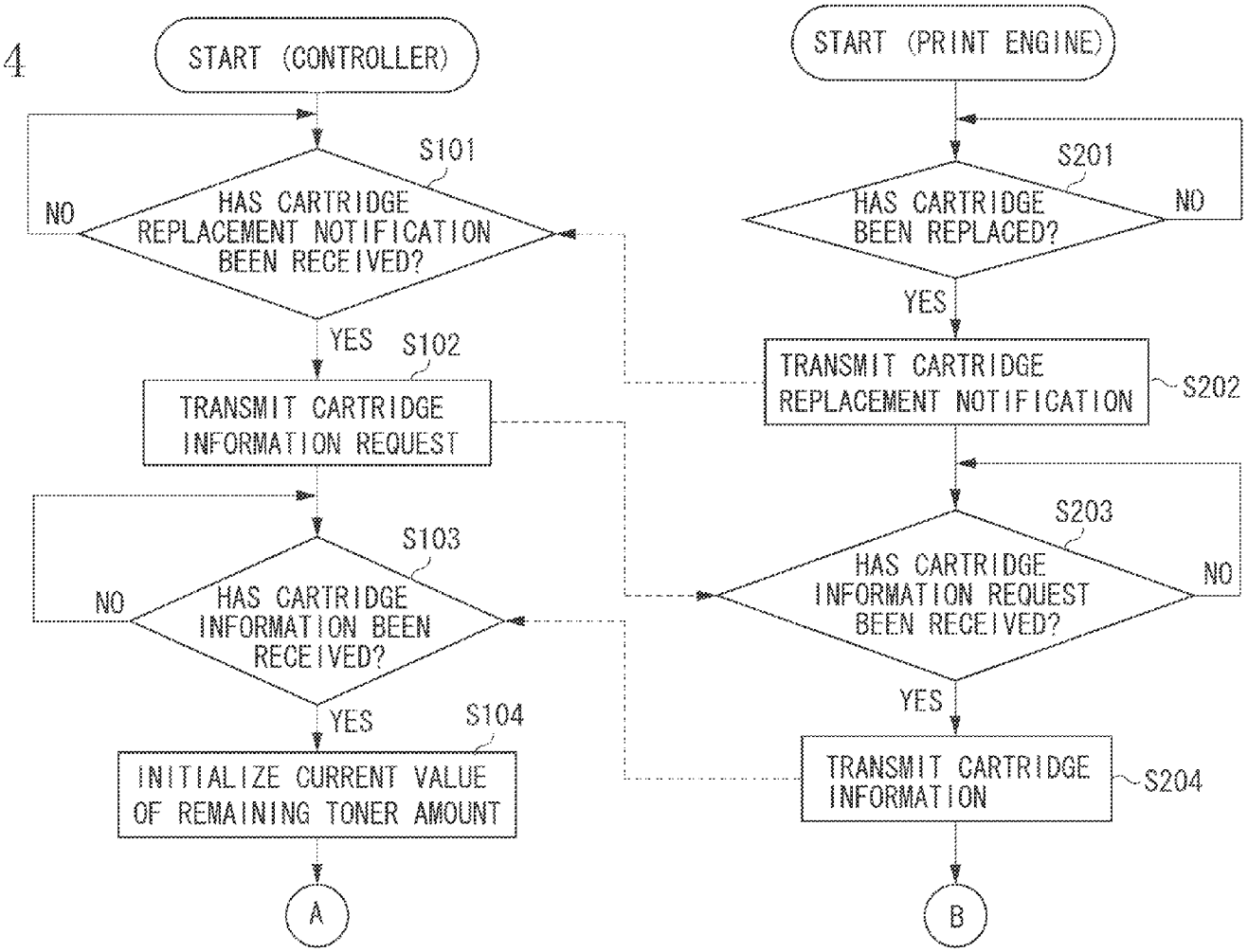
FIG. 4 is a flowchart (a first half) illustrating control of detection of a remaining toner amount.
Figure 5A:
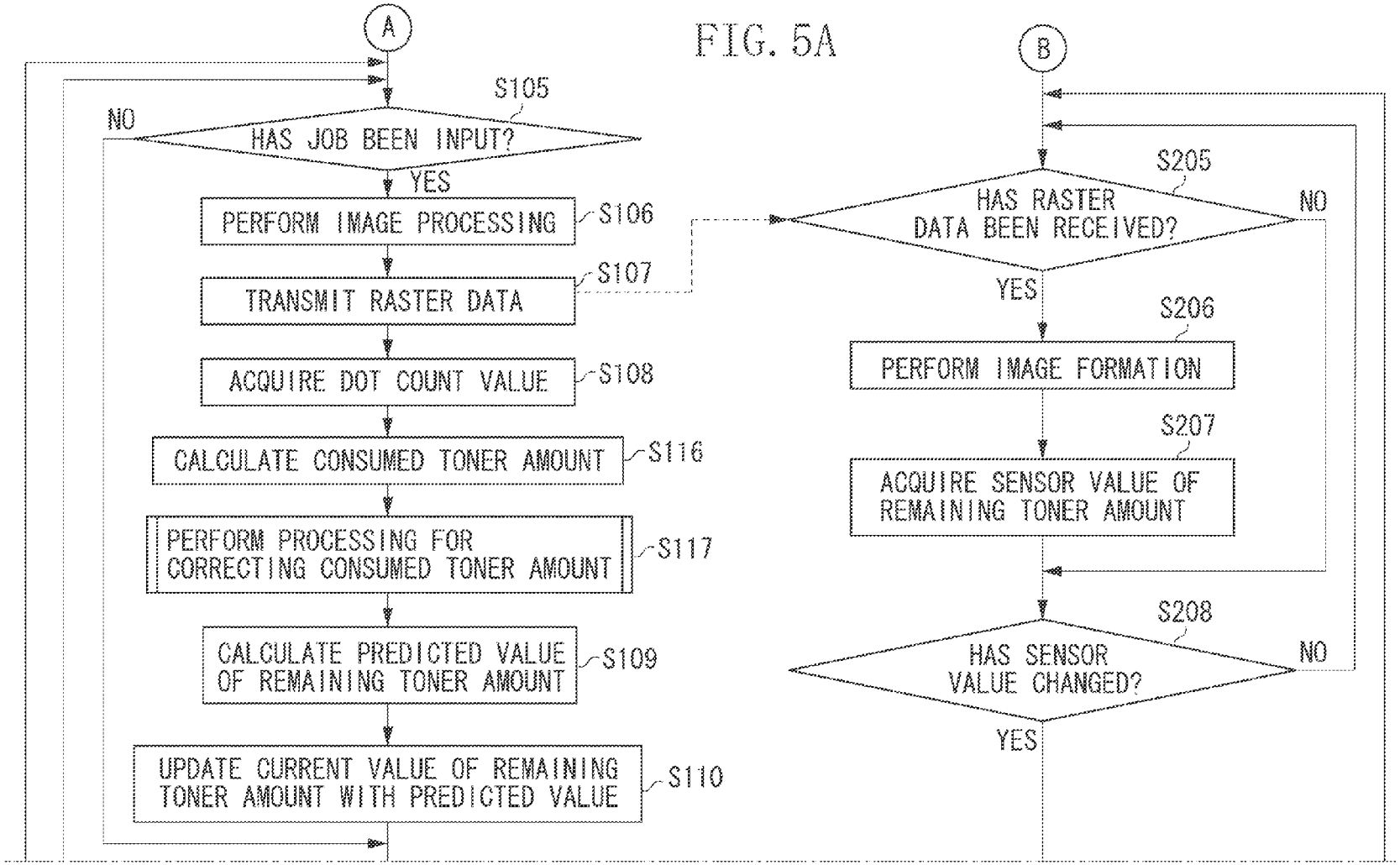
FIGS. 5A and 5B are a flowchart (a latter half) illustrating control of detection of a remaining toner amount.
Figure 5B:
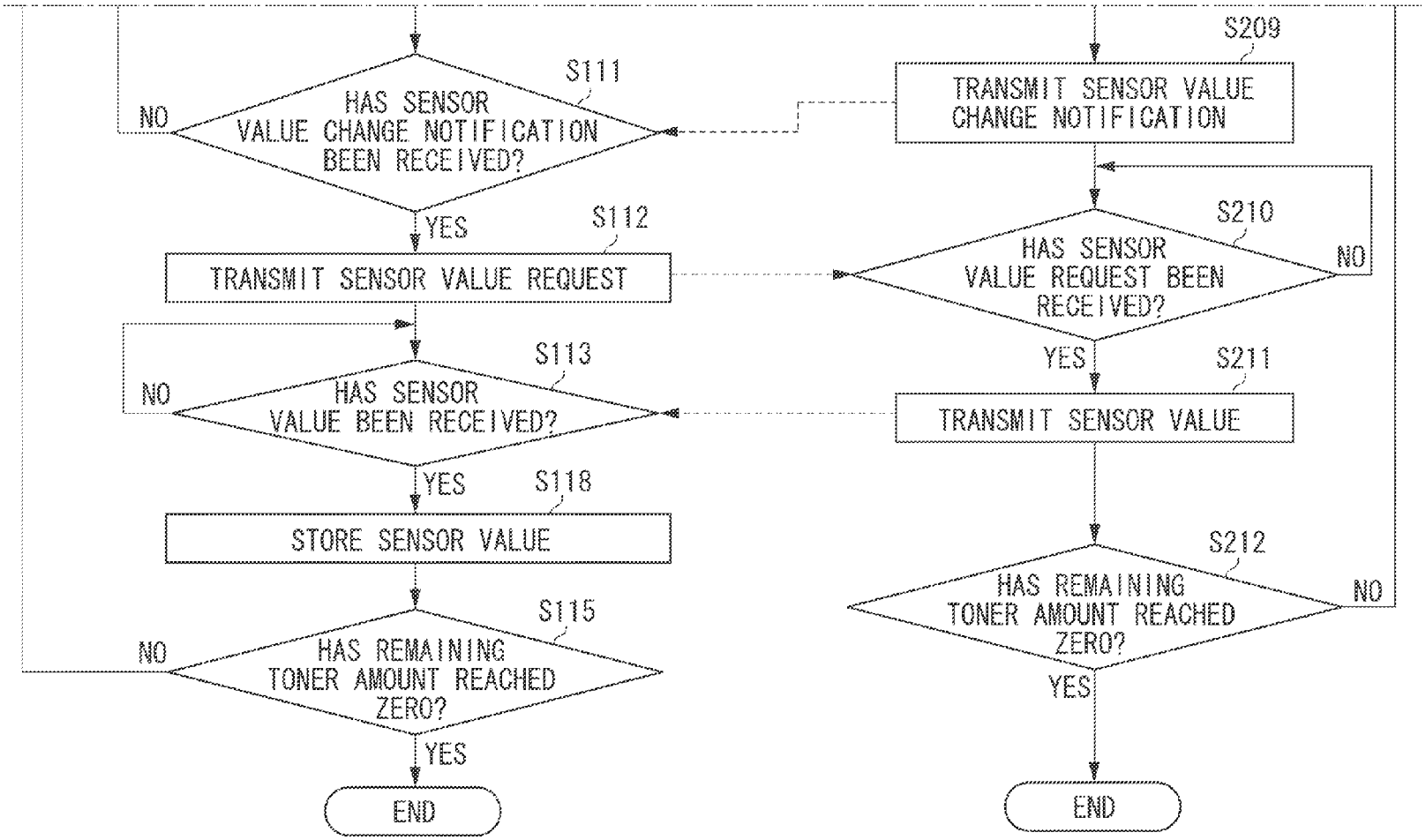

FIGS. 4 and 5 are flowcharts illustrating control to detect a remaining toner amount.

Control illustrated on the left side of the flowchart is implemented when the CPU 401 expands, into the RAM 403, a control program stored in the ROM 402 and executes the expanded control program. Control illustrated on the right side of the flowchart is implemented when the CPU 501 expands, into the RAM 503, a control program stored in the ROM 502 and executes the expanded control program.

In step S201, the CPU 501 first determines whether the cartridge 509 has been replaced. The determination is made by detecting that the cartridge 509 has newly been mounted on the image forming apparatus 102. It is recognized that the cartridge 509 has been mounted when the status change detection unit 506 detects the mounting of the cartridge 509 and notifies the CPU 501 of the detection of the mounting of the cartridge 509. The mounting of the cartridge 509 may be detected when a cover provided is opened or closed to replace the cartridge 509 or may be detected by a hardware button or switch that changes an ON/OFF state when a component is attached or detached. If the cartridge 509 has been replaced (YES in step S201), the processing proceeds to step S202. Otherwise (NO in step S201), the CPU 501 stands by.

In step S202, the CPU 501 then transmits a cartridge replacement notification to the controller 302 via the controller I/F 507. The cartridge replacement notification indicates that the cartridge 509 has been replaced.

In step S101, the CPU 401 then determines whether the cartridge replacement notification has been received from the print engine 303 via the engine I/F 406. If the cartridge replacement notification has been received (YES in step S101), the processing proceeds to step S102. Otherwise (NO in step S101), the CPU 401 stands by.

In step S102, the CPU 401 then transmits, to the print engine 303 via the engine I/F 406, a cartridge information request about the cartridge 509.

In step S203, the CPU 501 then determines whether the cartridge information request has been received from the controller 302 via the controller I/F 507. If the cartridge information request has been received (YES in step S203), the processing proceeds to step S204. Otherwise (NO in step S203), the CPU 501 stands by.

In step S204, the CPU 501 then transmits the cartridge information about the cartridge 509 to the controller 302 via the controller I/F 507.

In step S103, the CPU 401 then determines whether the cartridge information has been received from the print engine 303 via the engine I/F 406. If the cartridge information has been received (YES in step S103), the processing proceeds to step S104. Otherwise (NO in step S103), the CPU 401 stands by.

In step S104, the CPU 401 then initializes a current value of the remaining toner amount based on the cartridge information. The current value of the remaining toner amount means a value recognized as the remaining toner amount in the cartridge 509 by the controller 302 and to be presented to the user via the UI 301. Specifically, the current value of the remaining toner amount is initialized by setting the current value of the remaining toner amount to 100% if the cartridge 509 is found to be new with reference to the cartridge information. On the other hand, the current value of the remaining toner amount is initialized by setting the current value of the remaining toner amount to a value corresponding to remaining toner amount information included in the cartridge information, described above, if the cartridge 509 is not found to be new. The current value of the remaining toner amount is retained in the RAM 403.

In step S105, the CPU 401 then determines whether a job for which image formation is performed has been input from the data processing apparatus 101 via the external I/F 404. The job includes a PDL print job, a copy job, and a FAX receiving print job. If the job has been input (YES in step S105), the processing proceeds to step S106. Otherwise (NO in step S105), the processing proceeds to step S111.

In step S106, the CPU 401 then performs image processing for forming the image based on the job. The image processing includes processing for controlling the rendering unit 408 to rasterize print data and generate raster data.

In step S107, the CPU 401 then transmits the raster data generated by the image processing to the print engine 303 via the engine I/F 406.

In step S108, the CPU 401 then acquires a dot count value measured when the raster data is generated from the dot count unit 409. The dot count value is the number of pixels of a color other than white included in the raster data. The dot count value may be acquired in units of pages, or may be acquired in units of jobs.

In step S116, the CPU 401 then calculates a consumed toner amount based on the dot count value that has been acquired in step S108. More specifically, a calculation given below is performed.

(a dot count value [dot] at the time of printing a job or a page this time)×(a consumed toner amount for each dot [g/dot])=(a consumed toner amount [g] by executing the job this time)

The consumed toner amount for each dot can also be referred to as a consumed toner amount per pixel. The consumed toner amount for each dot may previously be stored in the ROM 402, or may be included in the cartridge information that has been received in step S103.

In step S117, the CPU 401 then performs processing for correcting the consumed toner amount that has been calculated in step S116. Details of the processing will be described below with reference to FIG. 6.

In step S109, the CPU 401 then calculates a predicted value of the remaining toner amount based on the consumed toner amount that has been corrected in step S117. More specifically, the following calculation is performed first.

(a present remaining toner amount [g])−(a consumed toner amount [g] after correction processing by executing a job this time)=(a new remaining toner amount [g])

Here, "−" means subtraction. Then, the following calculation is performed.

(a new remaining toner amount [g])/(a remaining toner amount [g] in an unused state of the cartridge 509)=(a predicted value [%] of the new remaining toner amount)

The remaining toner amount in the unused state of the cartridge 509 may previously be stored in the ROM 402, or may be included in the cartridge information that has been received in step S103.

In step S110, the CPU 401 then updates the current value of the remaining toner amount with the predicted value that has been calculated in step S109.

On the other hand, in step S205, the CPU 501 determines whether the raster data has been received from the controller 302 via the controller I/F 507. If the raster data has been received (YES in step S205), the processing proceeds to step S206. Otherwise (NO in step S205), the processing proceeds to step S208.

In step S206, the CPU 501 then controls the image forming unit 508, to perform image formation based on the raster data.

In step S207, the CPU 501 acquires a sensor value of the remaining toner amount from the remaining toner amount sensor 504. The sensor value may be acquired when the image formation is completed in units of pages, or when the image formation is completed in units of jobs. The sensor value may be acquired each time a predetermined period of time elapses.

In step S208, the CPU 501 then determines whether the sensor value acquired this time has changed from the sensor value acquired last time. If the sensor value has changed (YES in step S208), the processing proceeds to step S209. Otherwise (NO in step S208), the processing returns to step S205.

In step S209, the CPU 501 then transmits a sensor value change notification to the controller 302 via the controller I/F 507. The sensor value change notification indicates that the sensor value has changed.

In step S111, the CPU 401 then determines whether the sensor value change notification has been received from the print engine 303 via the engine I/F 406. If the sensor value change notification has been received (YES in step S111), the processing proceeds to step S112. Otherwise (NO in step S111), the processing returns to step S105.

In step S112, the CPU 401 then transmits a sensor value request to the print engine 303 via the engine I/F 406.

In step S210, the CPU 501 then determines whether the sensor value request has been received from the controller 302 via the controller I/F 507. If the sensor value request has been received (YES in step S210), the processing proceeds to step S211. Otherwise (NO in step S210), the CPU 501 stands by.

In step S211, the CPU 501 then transmits the sensor value to the controller 302 via the controller I/F 507.

In step S113, the CPU 401 then determines whether the sensor value has been received from the print engine 303 via the engine I/F 406. If the sensor value has been received (YES in step S113), the processing proceeds to step S118. Otherwise (NO in step S113), the CPU 401 stands by.

In step S118, the CPU 401 then stores the sensor value, which has been received in step S113, in the RAM 403.

In step S115, the CPU 401 then determines whether the remaining toner amount has reached zero with reference to the current value of the remaining toner amount. If the remaining toner amount has reached zero (YES in step S115), the processing ends. Otherwise (NO in step S115), the processing returns to step S105.

On the other hand, in step S212, the CPU 501 determines whether the remaining toner amount has reached zero with reference to the sensor value of the remaining toner amount. If the remaining toner amount has reached zero (YES in step S212), the processing ends. Otherwise (NO in step S212), the processing returns to step S205.

Figure 6:
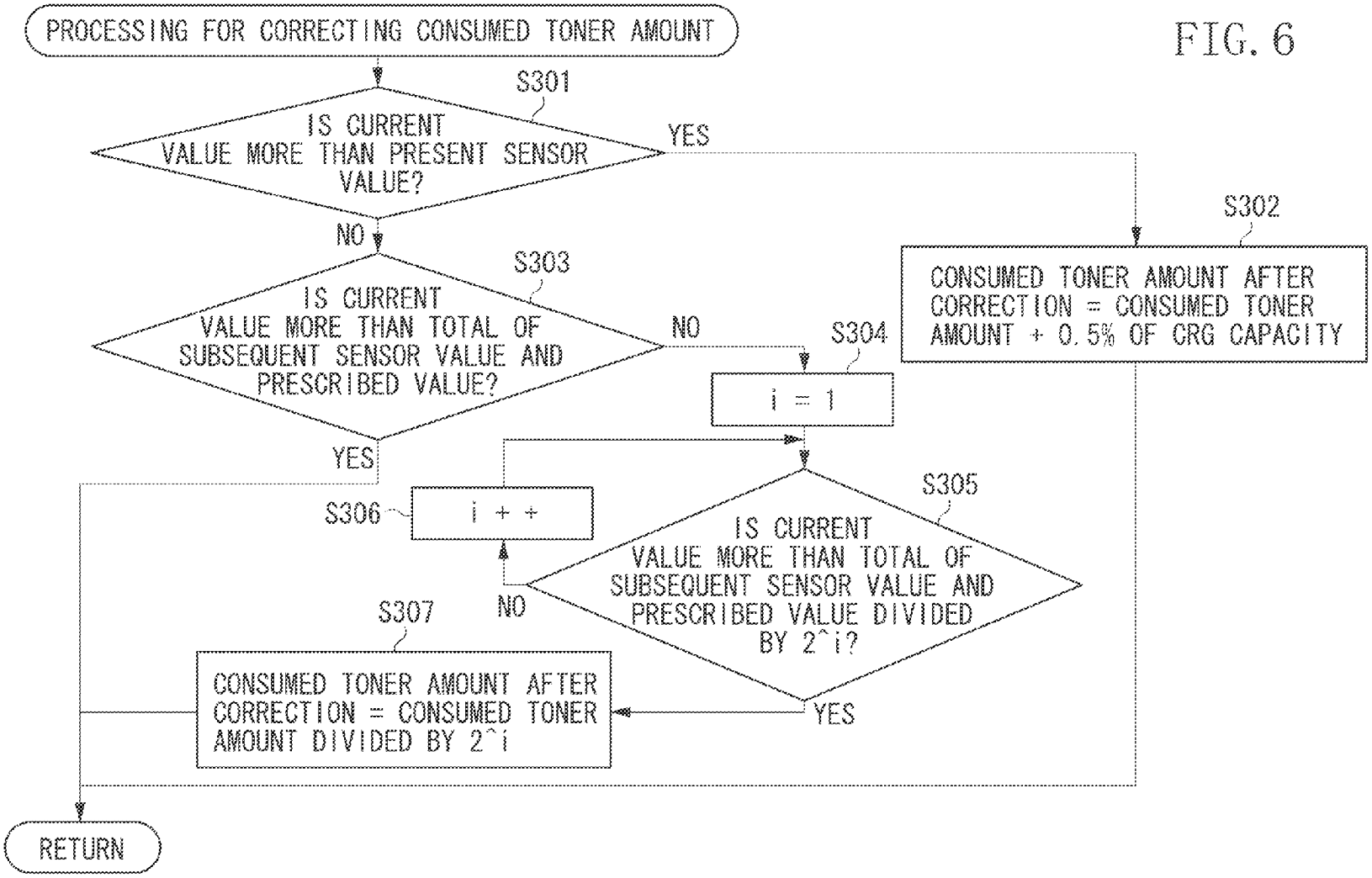
FIG. 6 is a flowchart illustrating details of processing for correcting a consumed toner amount (a first exemplary embodiment).

FIG. 6 is a flowchart illustrating details of processing for correcting a consumed toner amount (a first exemplary embodiment).

First, in step S301, the CPU 401 determines whether a current value of a present remaining toner amount (a predicted value of a remaining toner amount calculated last time: a current value of a remaining toner amount set last time) is more than a present sensor value (the sensor value that has been stored in the RAM 403 in step S118). If the current value of the present remaining toner amount is more than the present sensor value (YES in step S301), the processing proceeds to step S302. Otherwise (NO in step S301), the processing proceeds to step S303.

In step S302, the CPU 401 then sets the consumed toner amount to which a toner amount corresponding to 0.5% of a CRG capacity is added as a consumed toner amount after the correction. Then, the processing ends. As the value to be added to the consumed toner amount at this time, the percentage of the CRG capacity may be replaced with a percentage of the consumed toner amount or a percentage of the remaining toner amount.

In step S303, the CPU 401 then determines whether the current value of the present remaining toner amount (the predicted value of the remaining toner amount calculated last time: the current value of the remaining toner amount set last time) is more than the total of a subsequent sensor value (a sensor value to be acquired next time) and a prescribed value. The subsequent sensor value means a maximum value less than the present sensor value that can be acquired by an engine. In a case illustrated in FIG. 7, if the sensor value is 100%, the subsequent sensor value is 40%. If the sensor value is 40%, the subsequent sensor value is 0%. The prescribed value is a value for determining a starting point at which the processing starts. In this example, the prescribed value is 10%. If the current value of the present remaining toner amount is more than the total of the subsequent sensor value and the prescribed value (YES in step S303), the processing ends. At this time, the consumed toner amount is not corrected. Otherwise (NO in step S303), the processing proceeds to step S304.

In step S304, the CPU 401 then initializes a counter i to one.

In step S305, the CPU 401 then determines whether the current value of the present remaining toner amount (the predicted value of the remaining toner amount calculated last time: the current value of the remaining toner amount set last time) is more than the total of the subsequent sensor value and the prescribed value divided by 2^i. Here, 2^i means a power of two. If the current value of the present remaining toner amount is more than the total of the subsequent sensor value and the prescribed value divided by 2^i (YES in step S305), the processing proceeds to step S307. Otherwise (NO in step S305), the processing proceeds to step S306.

In step S306, the CPU 401 then increments the counter i.

In step S307, the CPU 401 sets the consumed toner amount divided by 2^i to a consumed toner amount after the correction. The processing then ends.

Figure 7:
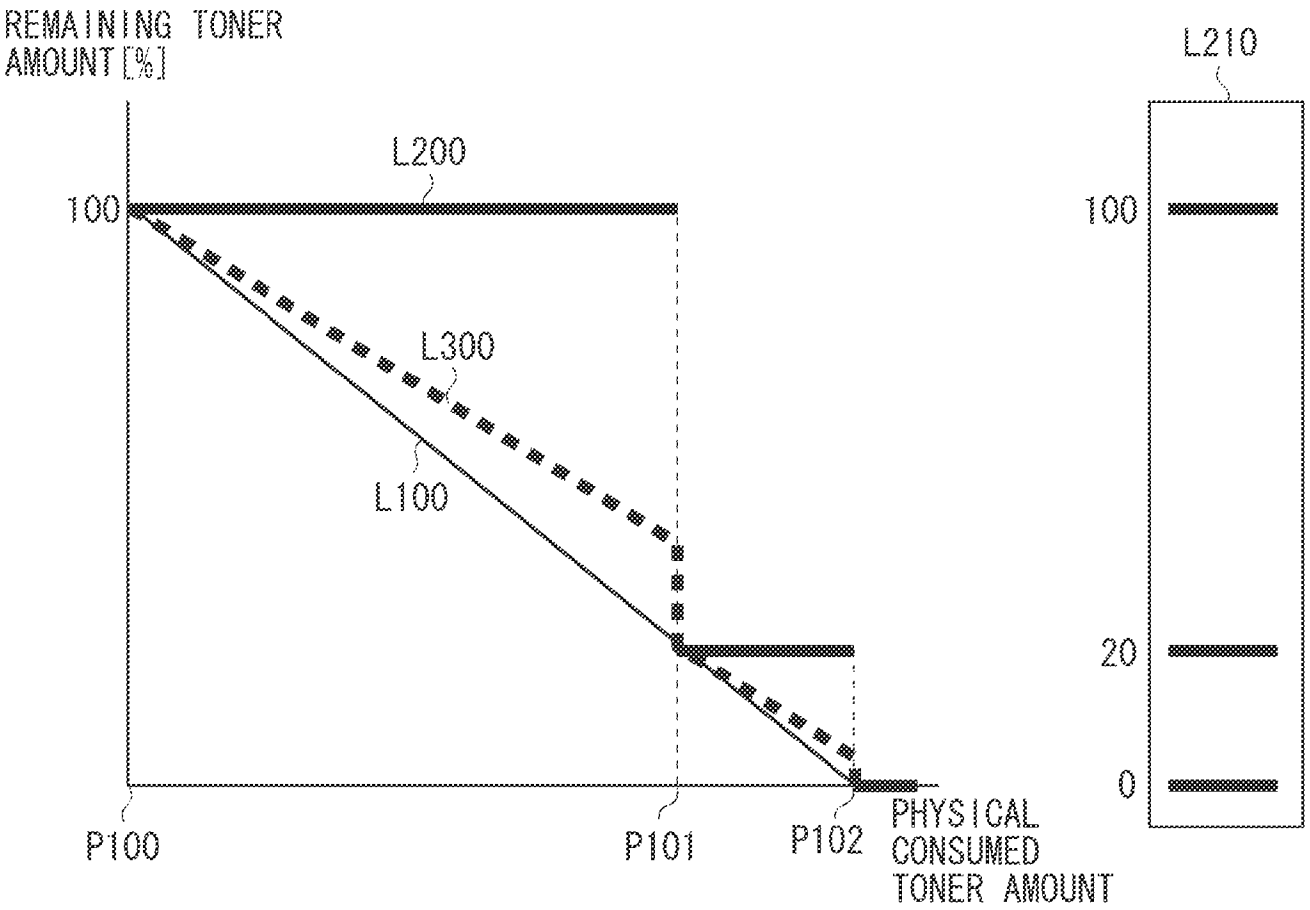
FIG. 7 illustrates a shift of a remaining toner amount (a conventional example).

FIG. 7 illustrates a shift of a remaining toner amount (a conventional example).

L100 is a shift of an actual remaining toner amount. The actual remaining toner amount is an accurate value of an actual remaining toner amount. The actual remaining toner amount is very difficult to directly acquire unless a sensor has a great accuracy over an entire area, for example.

L200 is a shift of a sensor value of the remaining toner amount.

L210 is a sensor value of the remaining toner amount which can be obtained by the sensor. In this example, the value which can be obtained is 100%, 20%, and 0%. The value 20% is a threshold value of a Low level (a state where the cartridge 509 almost runs out of toner, indicating replacement).

L300 is a shift of a current value of the remaining toner amount.

P100 to P102 are points of a physical amount. A relationship between each of the points and the current value is as follows.

The point P100 corresponds to the time when the current value of the remaining toner amount has been initialized to 100% in step S104 in a case where the cartridge 509 has been replaced.

A section between the points P100 and P101 corresponds to a section where a loop of steps S105 to S111 is repeated while the sensor value of the remaining toner amount changes from 100% to 20%. In the loop, a predicted value of the remaining toner amount is calculated and update of the current value of the remaining toner amount continues.

The point P101 corresponds to the time when the current value of the remaining toner amount rapidly changes. The point P101 corresponds to the time when the current value of the remaining toner amount has been updated to 20% with the predicted value of the remaining toner amount in step S110 when the sensor value of the remaining toner amount has changed from 100% to 20%.

A section between the points P101 and P102 corresponds to a section where the loop of steps S105 to S111 is repeated while the sensor value of the remaining toner amount changes from 20% to 0%. In the section, a predicted value of the remaining toner amount is calculated and update of the current value of the remaining toner amount continues.

The point P102 corresponds to the time when the current value of the remaining toner amount rapidly changes and the time when the current value of the remaining toner amount has been updated to 0% with the predicted value of the remaining toner amount in step S110 when the sensor value of the remaining toner amount has changed from 20% to 0%.

FIG. 8 illustrates a shift of a remaining toner amount (a first exemplary embodiment: a case where its current value shifts while being slightly higher than an actual remaining toner amount).

Figure 8A:
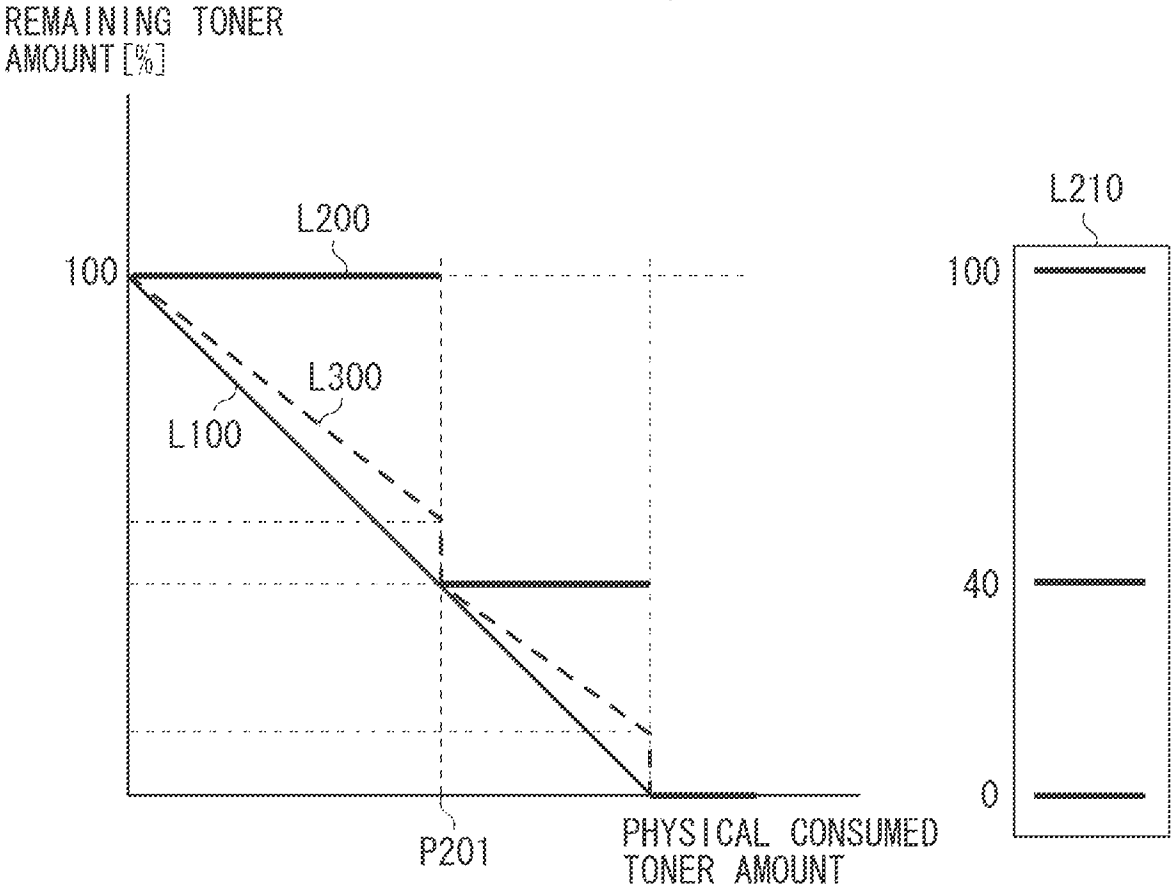
FIGS. 8A and 8B respectively illustrate shifts of a remaining toner amount (a first exemplary embodiment: a case where its current value shifts while being slightly higher than an actual remaining toner amount).

FIG. 8A illustrates a case where the present invention is not applied.

When the present invention is not applied, if a sensor value of the remaining toner amount becomes 40% at a point P201, the current value of the remaining toner amount is updated with the sensor value of the remaining toner amount.

As a result, when the present invention is not applied, the remaining toner amount rapidly decreases from 50% to 40%.

Figure 8B:
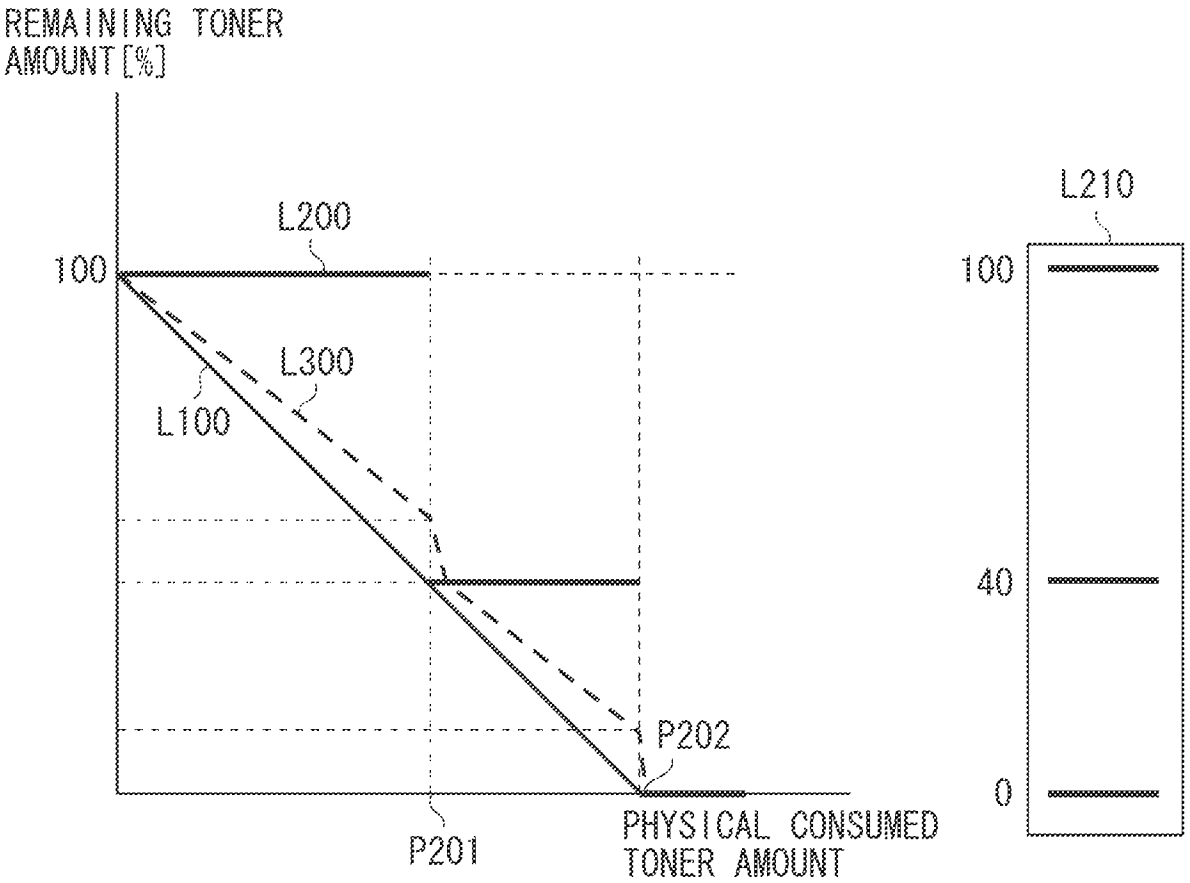

FIG. 8B illustrates a case where the present invention is applied.

When the present invention is applied, if a sensor value of the remaining toner amount becomes 40% at a point P201, the current value of the remaining toner amount does not immediately shift to 40%, and shifts while decreasing more greatly than before the point P201. It is because the current value of the remaining toner amount is more than the sensor value at the point P201 (YES in step S301), and 0.5% of a CRG capacity is added to a consumed toner amount.

When the present invention is applied, if the sensor value of the remaining toner amount becomes 0% at a point P202, the current value of the remaining toner amount does not immediately shift to 0%, but shifts while decreasing more greatly than before the point P201. In this case, a calculated value of the remaining toner amount is not 0% although 0% is detected as the sensor value. Thus, a blur may occur when printing is continued in this state. Therefore, when the sensor value is 0%, the processing may be switched to processing for increasing the consumed toner amount from that of a normal time, e.g., the processing is switched to processing for adding 2% of the CRG capacity to the consumed toner amount in step S302 or processing for halving the remaining toner amount.

As a result, when the present invention is applied, if the current value shifts while being slightly higher, the remaining toner amount can be prevented from significantly decreasing at a time point when the sensor value has changed.

FIG. 9 illustrates a shift of a remaining toner amount (a first exemplary embodiment: a case where its current value shifts while being slightly lower than an actual remaining toner amount).

Figure 9A:
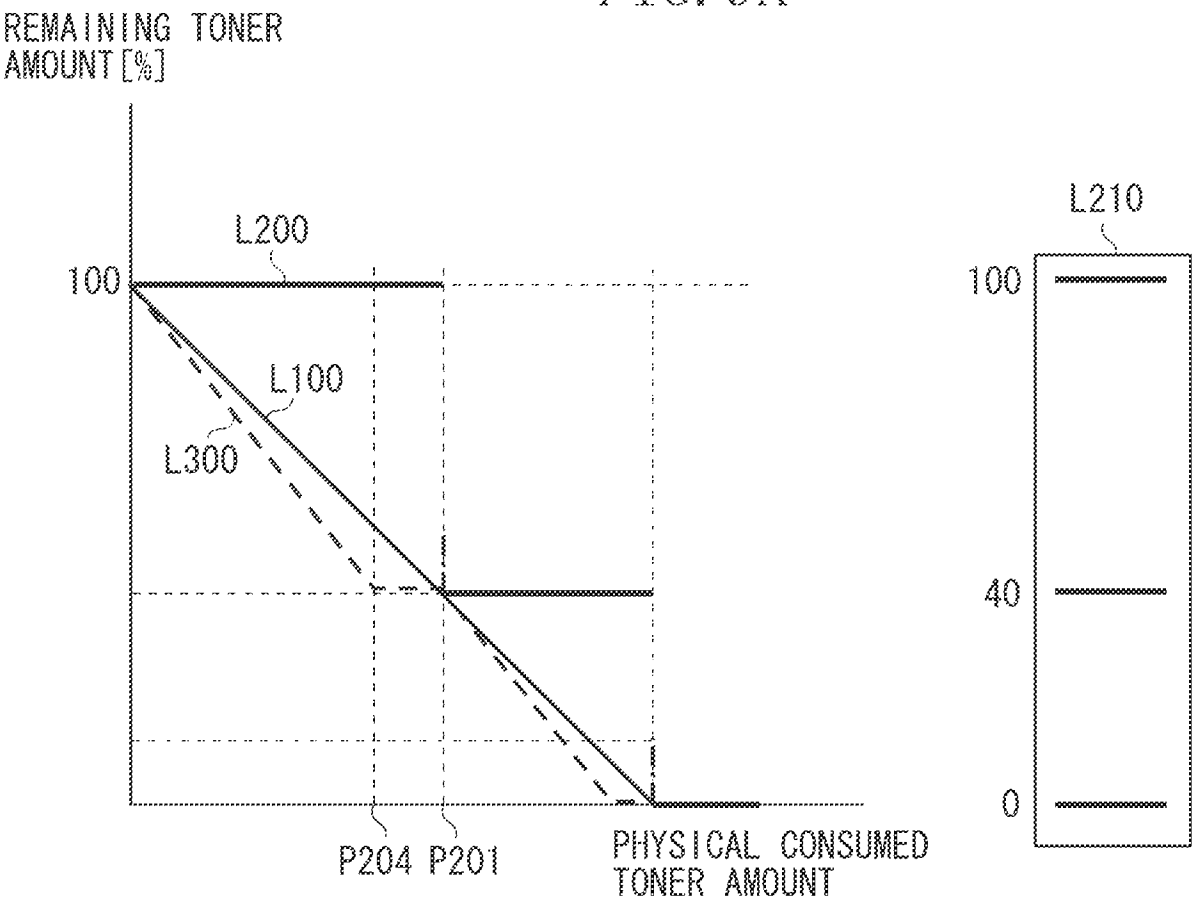
FIGS. 9A and 9B respectively illustrate shifts of a remaining toner amount (a first exemplary embodiment: a case where its current value shifts while being slightly lower than an actual remaining toner amount).

FIG. 9A illustrates a case where the present invention is not applied.

When the present invention is not applied, if a sensor value of the remaining toner amount is slightly more than 40% at a point P204, updating of the current value of the remaining toner amount temporarily stops. Then, the updating is resumed at a point P201.

As a result, when the present invention is not applied, the updating is not performed if a value is slightly more than 40%.

Figure 9B:
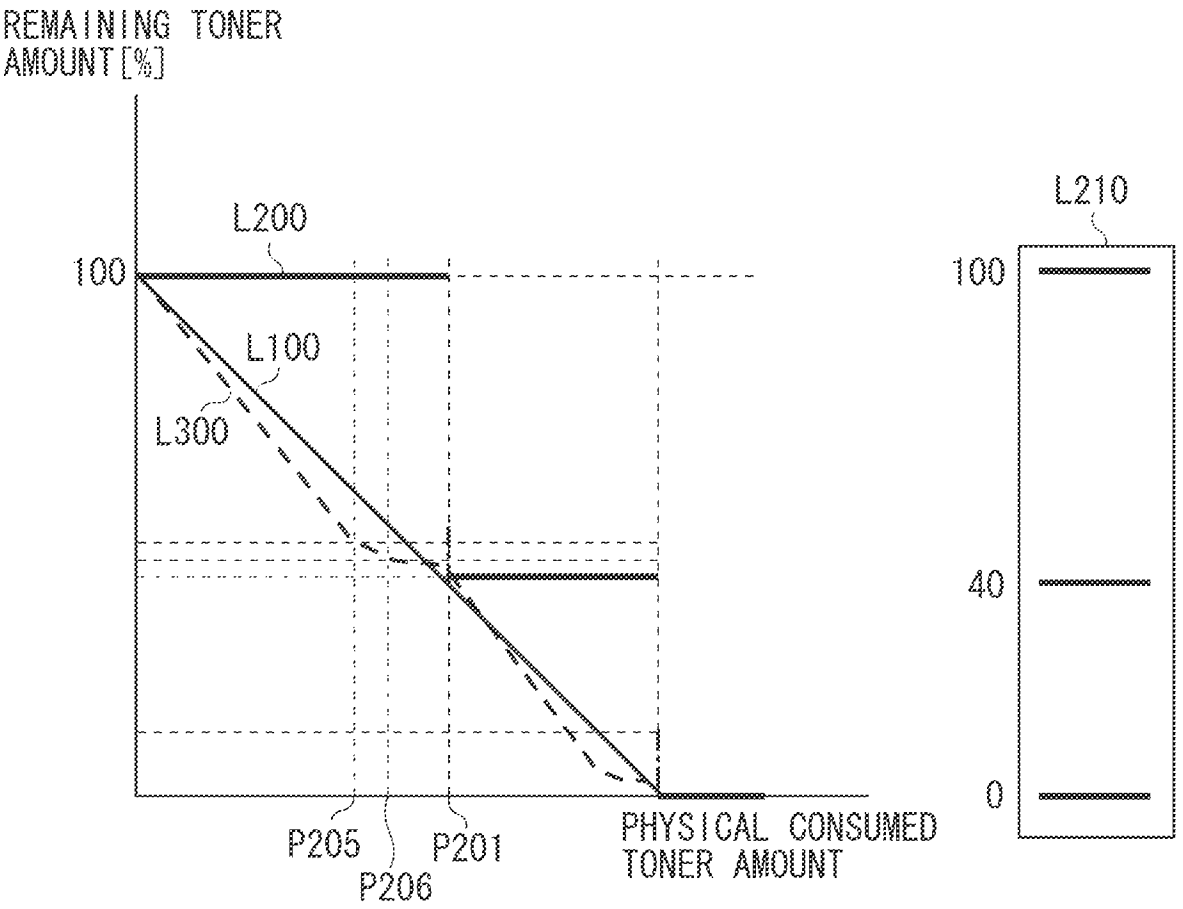

FIG. 9B illustrates a case where the present invention is applied.

When the present invention is applied, the current value of the remaining toner amount shifts decreasing to a smaller degree than before a point P205 in a section between the point P205 and a point P206. It is because a remaining toner amount calculated last time is not more than a value obtained by (a subsequent sensor value (40%)+the above-mentioned prescribed value (10%)=50%) (NO in step S303 and YES in step S305), and thus a consumed toner amount is equal to the consumed toner amount divided by two.

The consumed toner amount further decreases in a section between the point P205 and the point P206. It is because the remaining toner amount calculated last time is not more than a value obtained by (the subsequent sensor value (40%)+the above-mentioned prescribed value (10%)=50%) (NO in step S303, NO in step S305 for the first time, and YES in step S305 for the second time), and the consumed toner amount is equal to the consumed value divided by four.

As a result, when the present invention is applied, if the current value shifts while being slightly lower, temporary stop of the updating of the remaining toner amount can be prevented.

FIG. 10 illustrates a shift of a remaining toner amount (a first exemplary embodiment: a case where its sensor value is erroneously detected when its current value shifts while being slightly higher than an actual remaining toner amount).

Figure 10A:
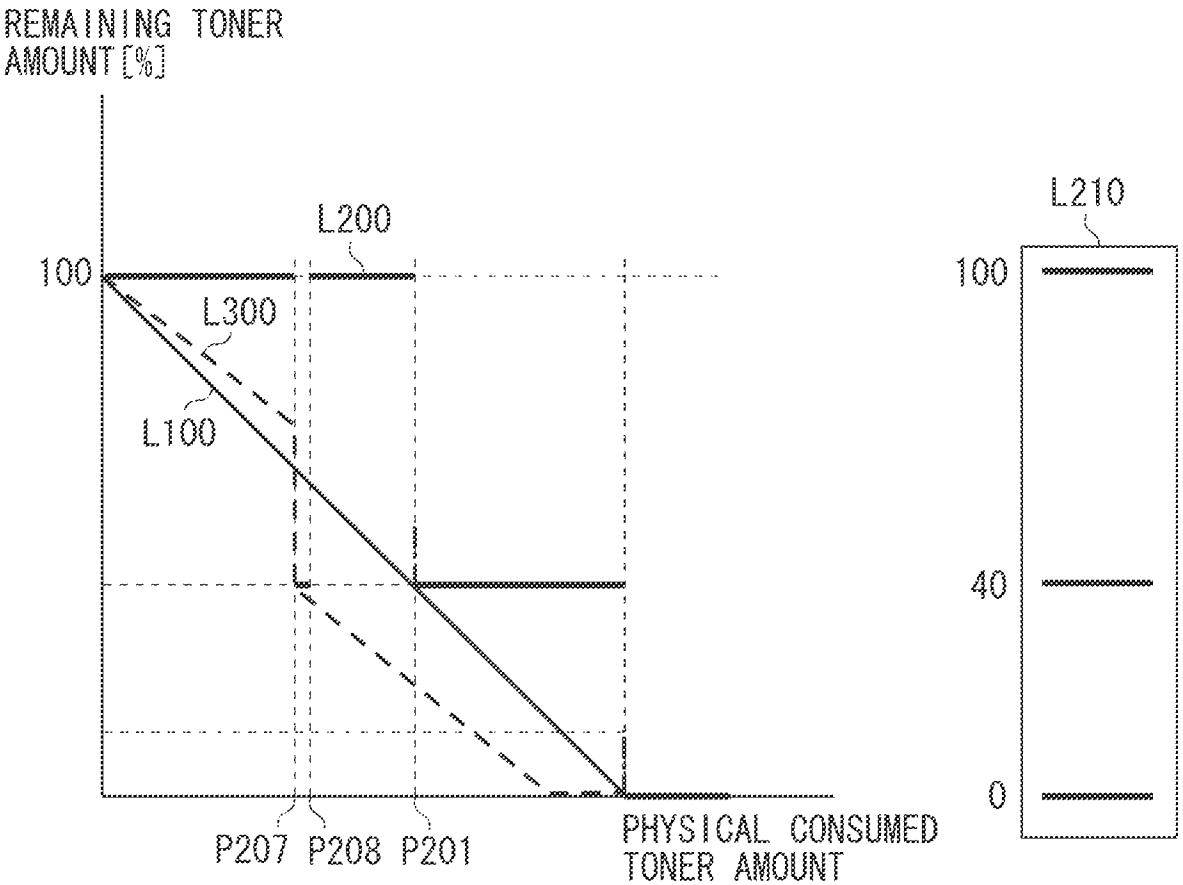
FIGS. 10A and 10B respectively illustrate shifts of a remaining toner amount (a first exemplary embodiment: a case where its sensor value is erroneously detected when its current value shifts while being slightly higher than an actual remaining toner amount).

FIG. 10A illustrates a case where the present invention is not applied.

When the present invention is not applied, even if the sensor value of the remaining toner amount becomes 40% at an early timing by the erroneous detection in a section from a point P207 to a point P208, the current value of the remaining toner amount is updated with the sensor value of the remaining toner amount.

Figure 10B:
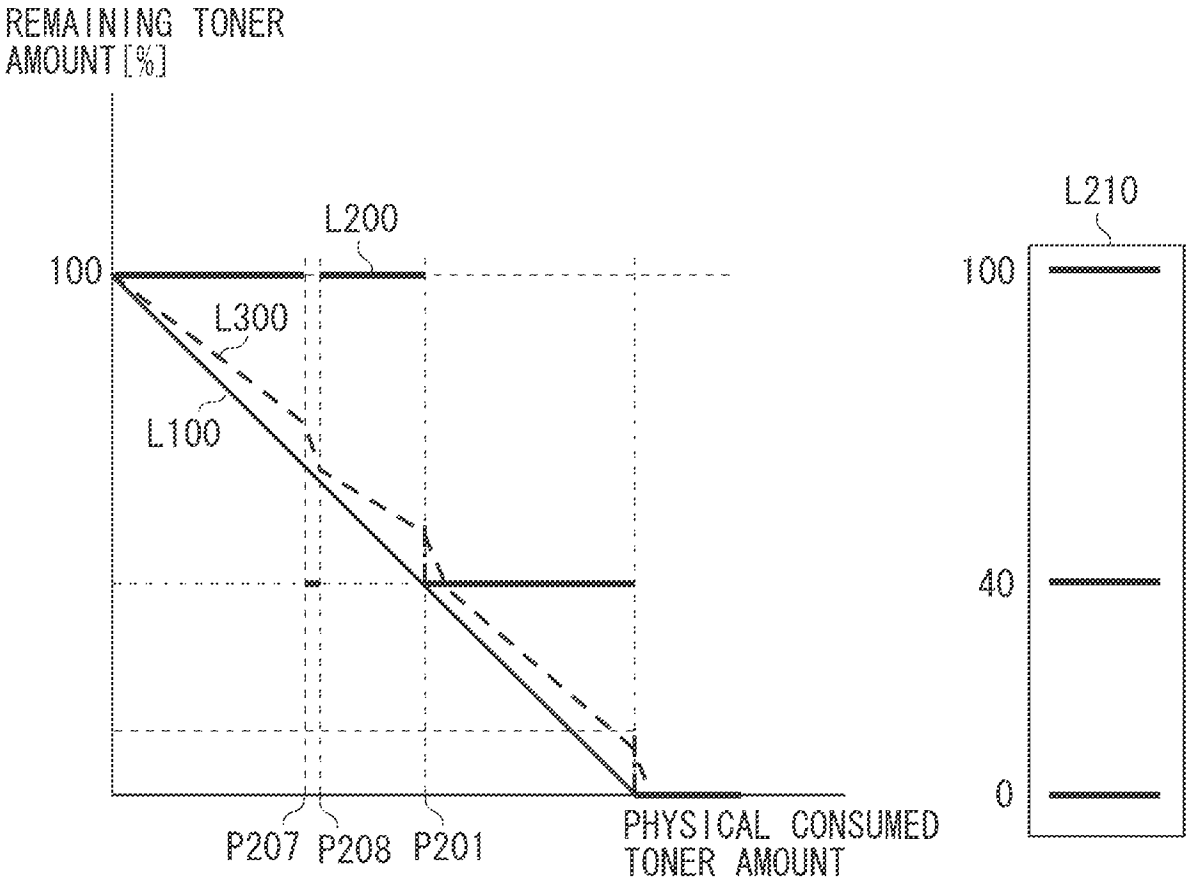

FIG. 10B illustrates a case where the present invention is applied.

When the present invention is applied, if the sensor value of the remaining toner amount becomes 40% at an earlier timing by the erroneous detection in a section from a point P207 to a point P208, the current value of the remaining toner amount shifts while decreasing to a greater degree than before the point P207. It is because a remaining toner amount calculated last time is more than the sensor value at the point P207 (YES in step S301), and 0.5% of a CRG capacity is added to a consumed toner amount.

As a result, even if the sensor value of the remaining toner amount is erroneously detected, the current value of the remaining toner amount can be prevented from greatly deviating from an ideal shift of the remaining toner amount.

According to a second exemplary embodiment, processing for correcting a consumed toner amount is changed from the first exemplary embodiment.

Description of portions (FIGS. 1 to 5) common to those in the first exemplary embodiment is not repeated.

Figure 11:
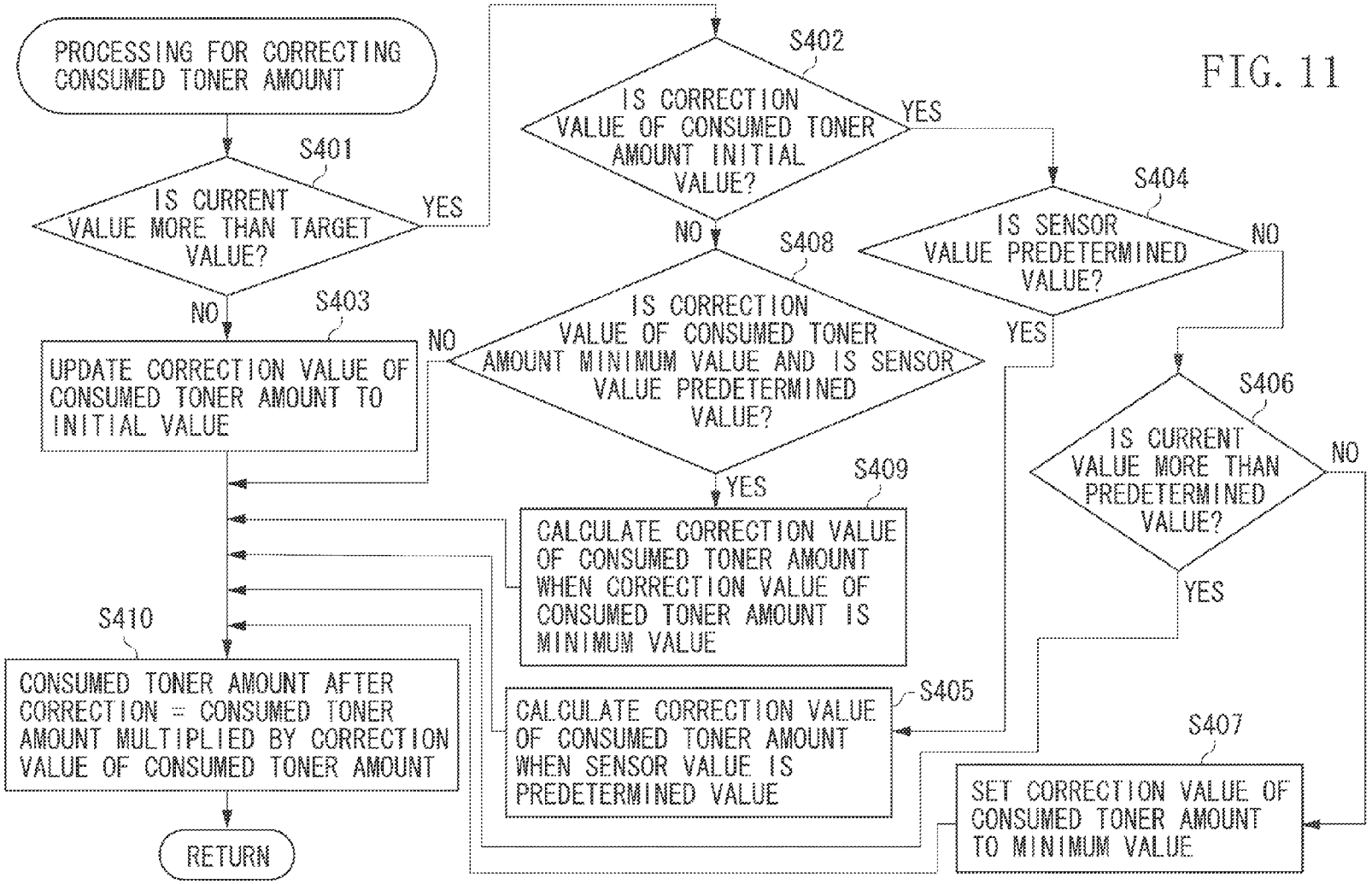
FIG. 11 is a flowchart illustrating details of processing for correcting a consumed toner amount (a second exemplary embodiment).

FIG. 11 is a flowchart illustrating details of processing for correcting the consumed toner amount (the second exemplary embodiment).

In step S401, a CPU 401 first determines whether a current value of a remaining toner amount (a predicted value of a remaining toner amount calculated last time) is more than a target value. The target value means a remaining toner amount at which a change of a correction value of the consumed toner amount is completed. The target value may be a fixed value previously determined or a value set by the CPU 401 via a panel I/F 405 according to input from the UI 301. The target value is set to 20% this time. If the current value of the remaining toner amount is more than the target value (YES in step S401), the processing proceeds to step S402. Otherwise (NO in step S401), the processing proceeds to step S403.

In step S403, the CPU 401 then updates the correction value of the consumed toner amount to an initial value.

In step S402, the CPU 401 then determines whether the correction value of the consumed toner amount is the initial value. If the correction value of the consumed toner amount is the initial value (YES in step S402), the processing proceeds to step S404. Otherwise (NO in step S402), the processing proceeds to step 408.

In step S404, the CPU 401 then determines whether a sensor value of the remaining toner amount is a predetermined value. The predetermined value means one of values that can be acquired by a sensor. The predetermined value is set to 40% this time. If the sensor value is the predetermined value (YES in step S404), the processing proceeds to step S405. Otherwise (NO in step S404), the processing proceeds to step S406.

In step S405, the CPU 401 then calculates the correction value of the consumed toner amount, if it is determined in step S404 that the sensor value is the predetermined value. The following calculation equation (1) is used for the calculation:

$$\text{correction value of consumed toner amount} = \frac{\dfrac{\text{previous remaining toner amount} - \text{target value}}{\text{sensor value} - \text{target value}}}{\text{last error corrected value} - \dfrac{\text{previous remaining toner amount}}{\text{last error corrected value} - \text{sensor value}}} \tag{1}$$

When a sensor value that can first be acquired is 40%, a value in which error has last been corrected (a last error corrected value) is 100%, a remaining toner amount calculated last time (a previous remaining toner amount) is 50%, and a target value is 20%, for example, a calculation result of the correction value of the consumed toner amount is obtained as follows.

$$((50\%-20\%)/(40\%-20\%))/((100\%-50\%)/(100\%-40\%))=1.8$$

These values may be a percentage of a CRG capacity in a toner container or may be a weight of toner itself.

In step S406, the CPU 401 then determines whether the current value of the remaining toner amount (the predicted value of the remaining toner amount calculated last time) is more than a predetermined value. If the current value of the remaining toner amount is more than the predetermined value (YES in step S406), the processing proceeds to step S410. Otherwise (NO in step S406), the processing proceeds to step S407.

In step S407, the CPU 401 then sets the correction value of the consumed toner amount to a minimum value. The minimum value means, when the consumed toner amount is calculated in step S410 using this value as the correction value of the consumed toner amount, a maximum value at which notification of the sensor value having a predetermined value is guaranteed while the current value of the remaining toner amount shifts from the predetermined value to the target value. The minimum value may be information previously defined in a module of a program retained in a ROM 402, or may be information retained by a print engine 303 and acquired via an engine I/F 406 by the CPU 401 when a power source is turned on. Alternatively, the minimum value may be calculated from the total of dot count values acquired from a dot count unit 409.

In step S408, the CPU 401 then determines whether the correction value of the consumed toner amount is the minimum value and the sensor value is the predetermined value. If the correction value of the consumed toner amount is the minimum value and the sensor value is the predetermined amount (YES in step S408), the processing proceeds to step S409. Otherwise (NO in step S408), the processing proceeds to step S410.

In step S409, the CPU 401 then calculates the correction value of the consumed toner amount. The following calculation equation (2) is used for the calculation.

$$\text{correction value of consumed toner amount} = \frac{\text{previous remaining toner amount} - \text{targert value}}{\text{sensor value} - \text{target value}} \times \frac{\text{last error corrected value} - \text{sensor value}}{\left(\text{last error corrected value} - \text{sensor value}\right) + \text{sensor value} - \dfrac{\text{previous remaining toner amount}}{\text{minimum value}}} \tag{2}$$

When a sensor value that can first be acquired is 40%, a value whose error has last been corrected (a last error corrected value) is 100%, a remaining toner amount calculated last time (a previous remaining toner amount) is 38%, a target value is 20%, and a minimum value is 0.1%, for example, the correction value of the consumed toner amount is obtained as follows.

$$((38\%-20\%)/(40\%-20\%))\times(100\%-40\%)/((100\%-40\%)+(40\%-38\%)/0.1)=0.675$$

These values may be a percentage of a CRG capacity in a toner container or may be a weight of toner itself.

In step S410, the CPU 401 then sets the consumed toner amount multiplied by the correction value of the consumed toner amount to a consumed toner amount after the correction. Then, the processing ends.

FIG. 12 illustrates a shift of a remaining toner amount (a second exemplary embodiment: a case where its current value shifts while being slightly higher than an actual remaining toner amount).

Figure 12A:
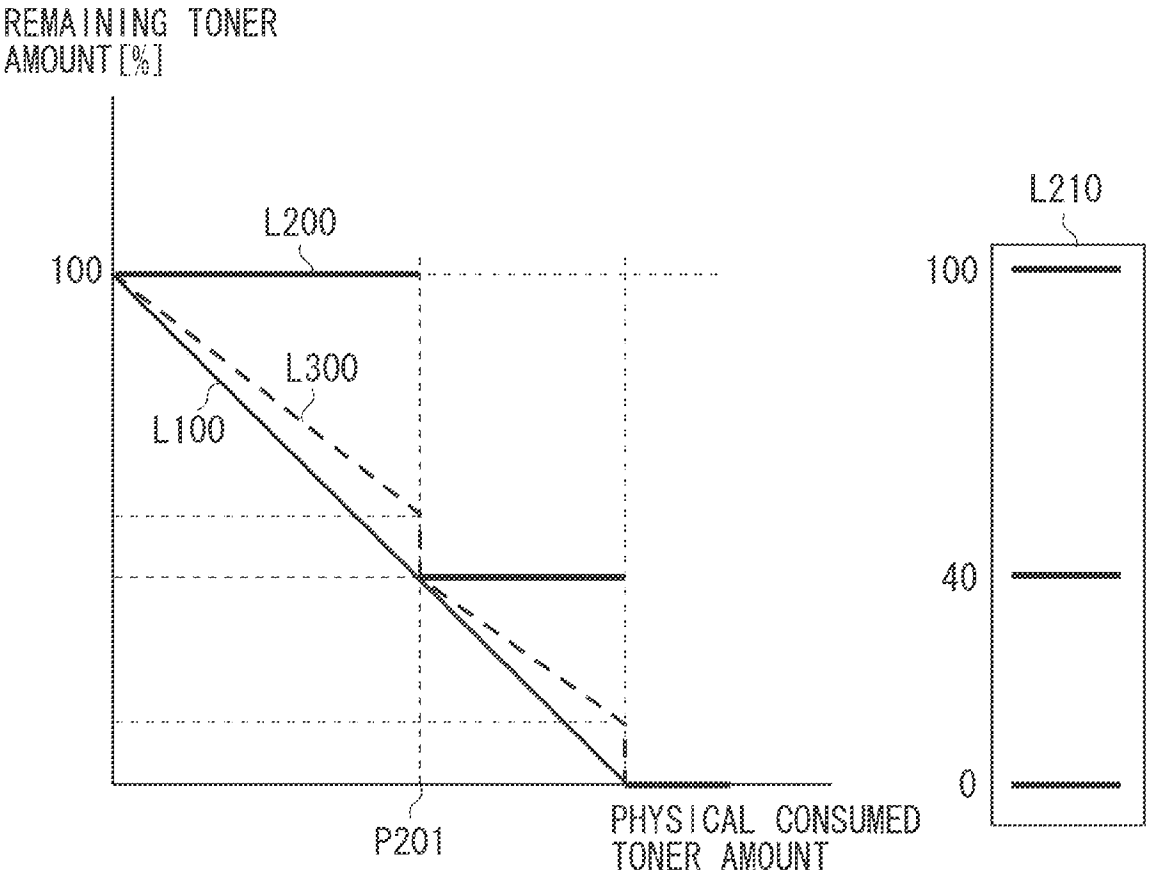
FIGS. 12A and 12B respectively illustrate shifts of a remaining toner amount (a second exemplary embodiment: a case where its current value shifts while being slightly higher than an actual remaining toner amount).

FIG. 12A illustrates a case where the present invention is not applied.

When the present invention is not applied, if a sensor value of the remaining toner amount becomes 40% at a point P201, the current value of the remaining toner amount is updated with the sensor value of the remaining toner amount.

As a result, when the present invention is not applied, the remaining toner amount rapidly decreases from 50% to 40%.

Figure 12B:
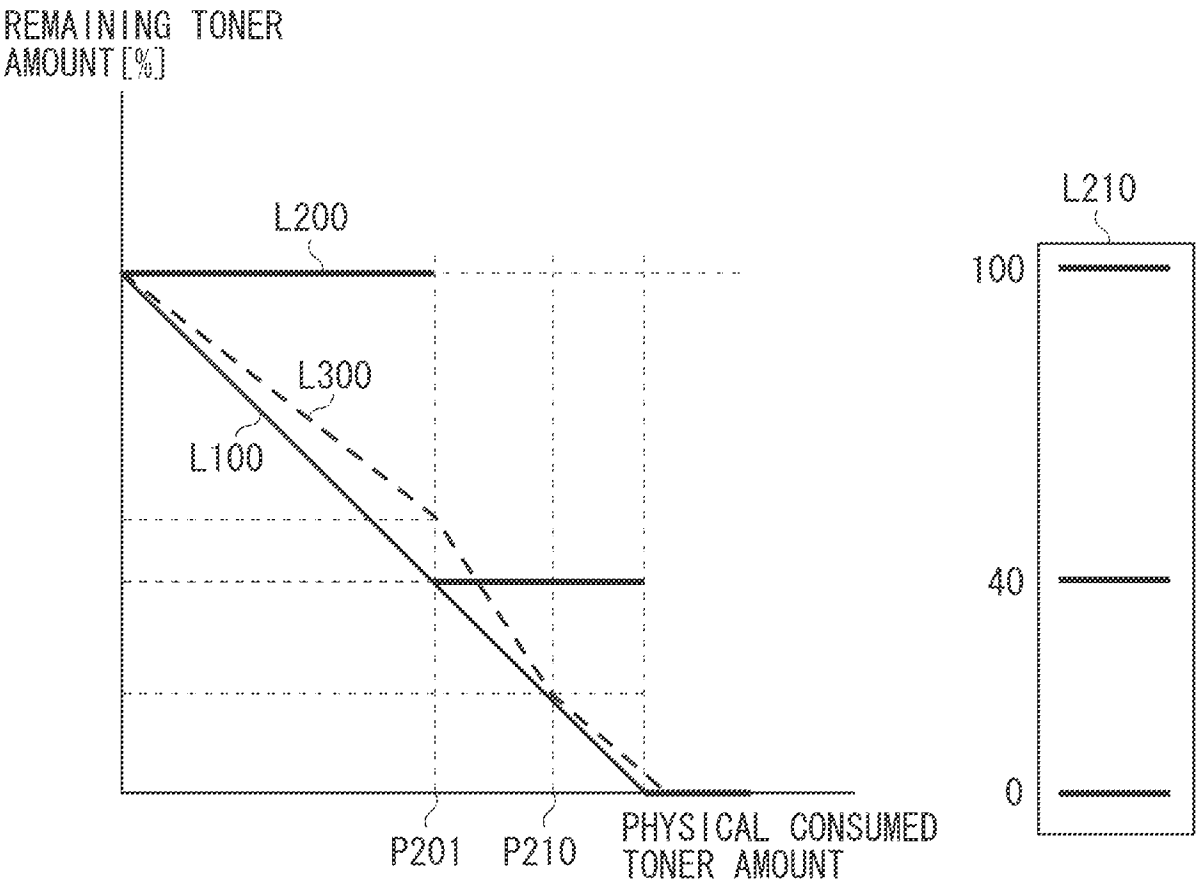

FIG. 12B illustrates a case where the present invention is applied.

When the present invention is applied, the current value of the remaining toner amount gradually shifts from a point P201 to a point P210. It is because at the point P201, a sensor value of the remaining toner amount becomes 40% (YES in step S404), and a correction value of a consumed toner amount is calculated.

At the point P210, the shift returns to the same shift as a shift before the point P201. It is because the current value of the remaining toner amount becomes 20%, which is a target value (NO in step S401), and the correction value of the consumed toner amount is returned to an initial value.

As a result, when the present invention is applied, if the current value shifts while being slightly lower, temporary stop of the updating of the remaining toner amount can be prevented.

FIG. 13 illustrates a shift of a remaining toner amount (a second exemplary embodiment: a case where its current value shifts while being slightly lower than an actual remaining toner amount).

Figure 13A:
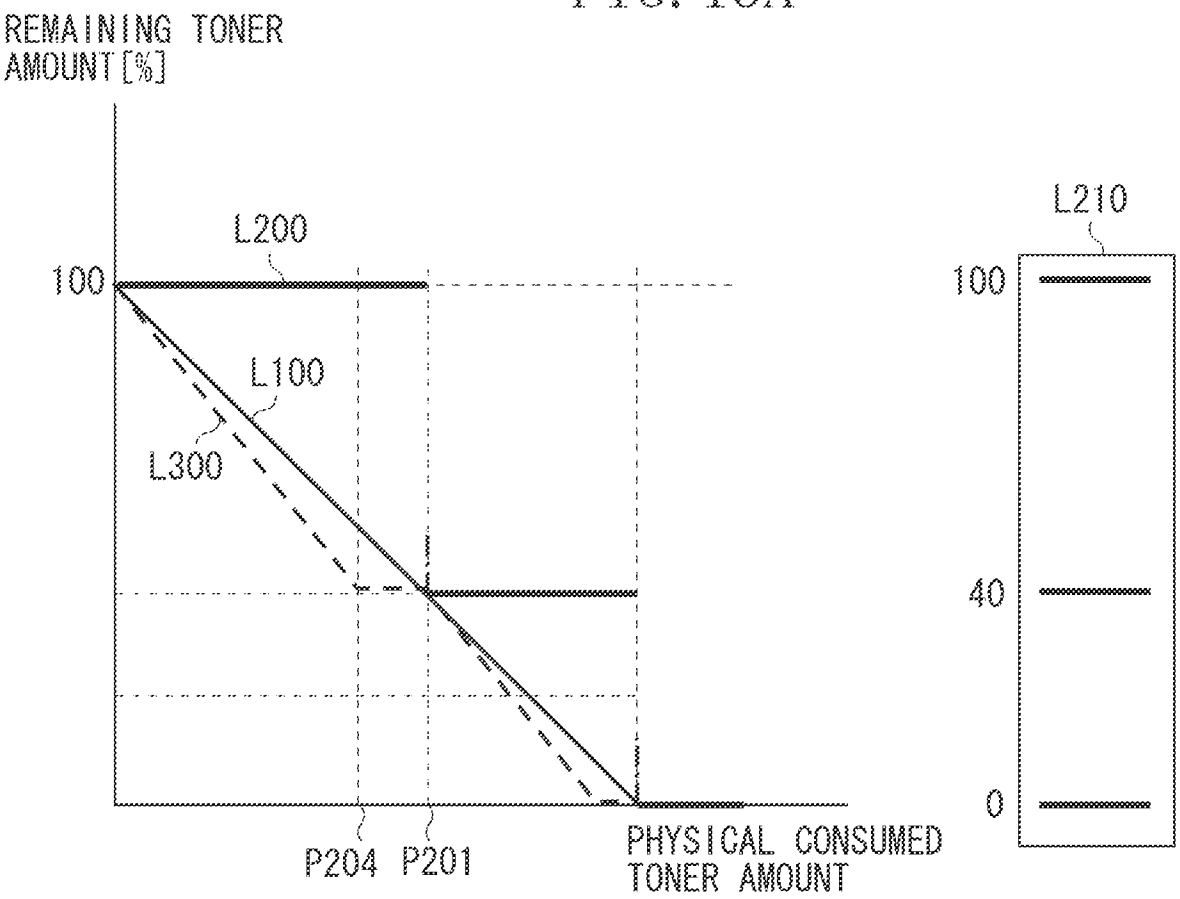
FIGS. 13A and 13B respectively illustrate shifts of a remaining toner amount (a second exemplary embodiment: a case where its current value shifts while being slightly lower than an actual remaining toner amount).

FIG. 13A illustrates a case where the present invention is not applied.

When the present invention is not applied, if a sensor value of the remaining toner amount is slightly more than 40% at a point P204, updating of the current value of the remaining toner amount temporarily stops. Then, the updating is resumed at a point P201.

As a result, when the present invention is not applied, the updating is not performed at a value slightly more than 40%.

Figure 13B:
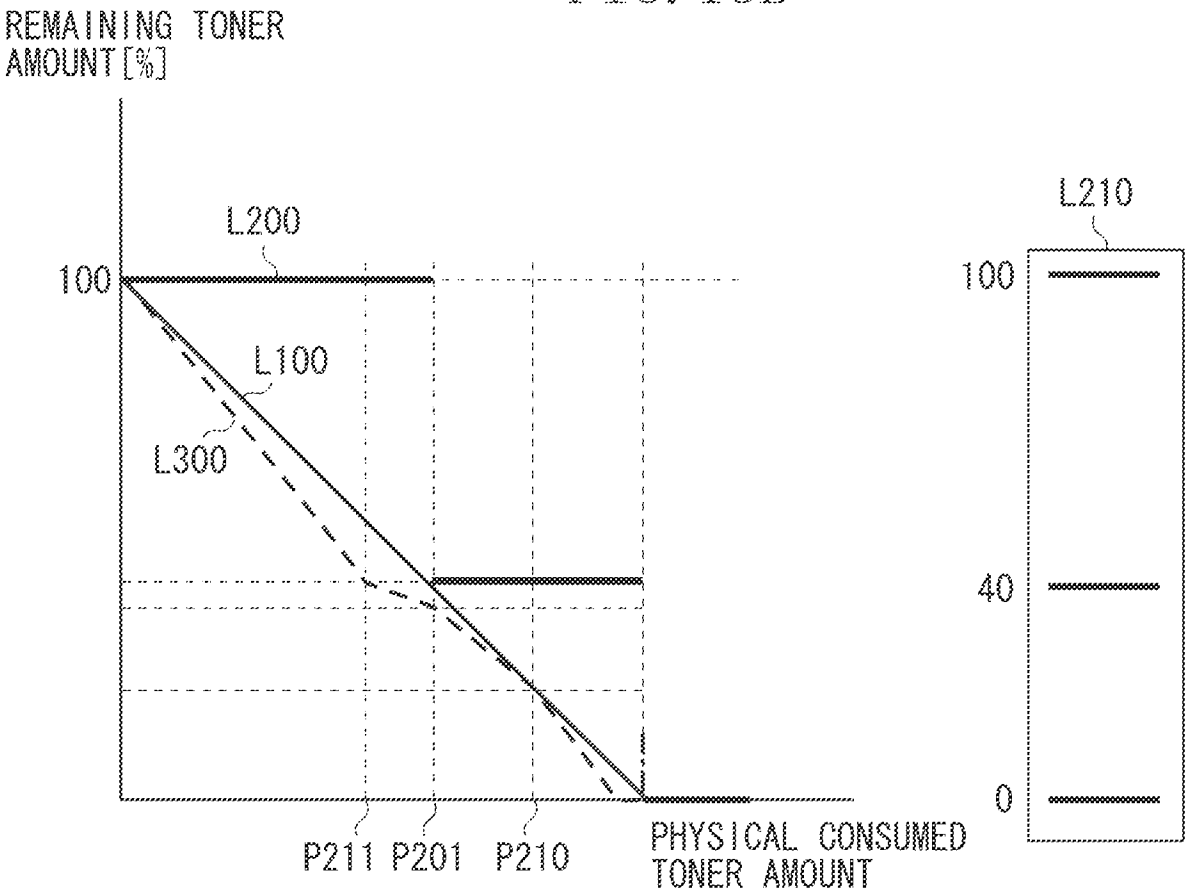

FIG. 13B illustrates a case where the present invention is applied.

When the present invention is applied, the current value of the remaining toner amount shifts while decreasing slightly in a section from a point P211 to a point P201. It is because a remaining toner amount calculated last time is not more than a predetermined value of the sensor value at the point P211 (NO in step S406), and a correction value of a consumed toner amount is set to a minimum value so that the consumed toner amount is updated.

The current value of the remaining toner amount shifts while decreasing more greatly in a section from a point P201 to a point P210. It is because the correction value of the consumed toner amount becomes the minimum value and the sensor value becomes the predetermined value at the point P201, the correction value of the consumed toner amount is calculated in step S409, and the consumed toner amount is updated.

At the point P210, the shift returns to the same shift as the shift before the point P201. It is because the current value of the remaining toner amount becomes 20%, which is a target value (NO in step S401), and the correction value of the consumed toner amount is updated to an initial value.

As a result, when the present invention is applied, if the current value shifts while being slightly lower, temporary stop of the updating of the consumed toner amount can be prevented.

In a third exemplary embodiment, equations used for processing for correcting a consumed toner amount are changed from those in the second exemplary embodiment.

Description of portions (FIGS. 1 to 5) common to those in the first exemplary embodiment and portions (FIGS. 1 to 5) common to those in the second exemplary is not repeated.

In the present exemplary embodiment, the equation (1) is replaced with the following equation (3), and the equation (2) is replaced with the following equation (4):

$$\text{correction value of consumed toner amount} = \frac{(\text{previous remaining toner amount} - \text{target value})}{\text{target value} - \left(\begin{matrix}\text{sensor value} - \\ \text{target value}\end{matrix}\right) - \dfrac{\text{third predetermined value}}{\text{last error corrected value} - \dfrac{\text{previous remaining toner amount}}{\text{last error corrected value} - \text{sensor value}}} + \left(\begin{matrix}\text{target value} - \\ \text{third predetermined value}\end{matrix}\right)} \div \left(\begin{matrix}\text{last error corrected value} - \\ \dfrac{\text{previous remaining toner amount}}{\text{last error corrected value} - \text{sensor value}}\end{matrix}\right) \tag{3}$$

$$\text{ccorrection value of consumed toner amount} = \frac{(\text{previous remaining toner amount} - \text{target value})}{\left(\begin{matrix}\text{last error corrected value} - \\ \text{sensor value}\end{matrix}\right) + \left(\begin{matrix}\text{sensor value} - \\ \text{targtet value}\end{matrix}\right) + \dfrac{\text{sensor value} - \dfrac{\text{previous remaining toner amout}}{\text{minimum value}}}{\text{last error corrected value} - \text{sensor value}}} \div \left(\begin{matrix}\text{last error corrected value} - \\ \text{sensor value}\end{matrix}\right) + \dfrac{\text{sensor value} - \dfrac{\text{previous remaining toner amount}}{\text{minimum value}}}{\text{last error corrected value} - \text{sensor value}} \tag{4}$$

FIG. 14 illustrates a shift of a remaining toner amount (a third exemplary embodiment: a case where its current value shifts while being slightly higher than an actual remaining toner amount).

In FIG. 14, description of portions common to those illustrated in FIG. 12 is not repeated.

Figure 14A:
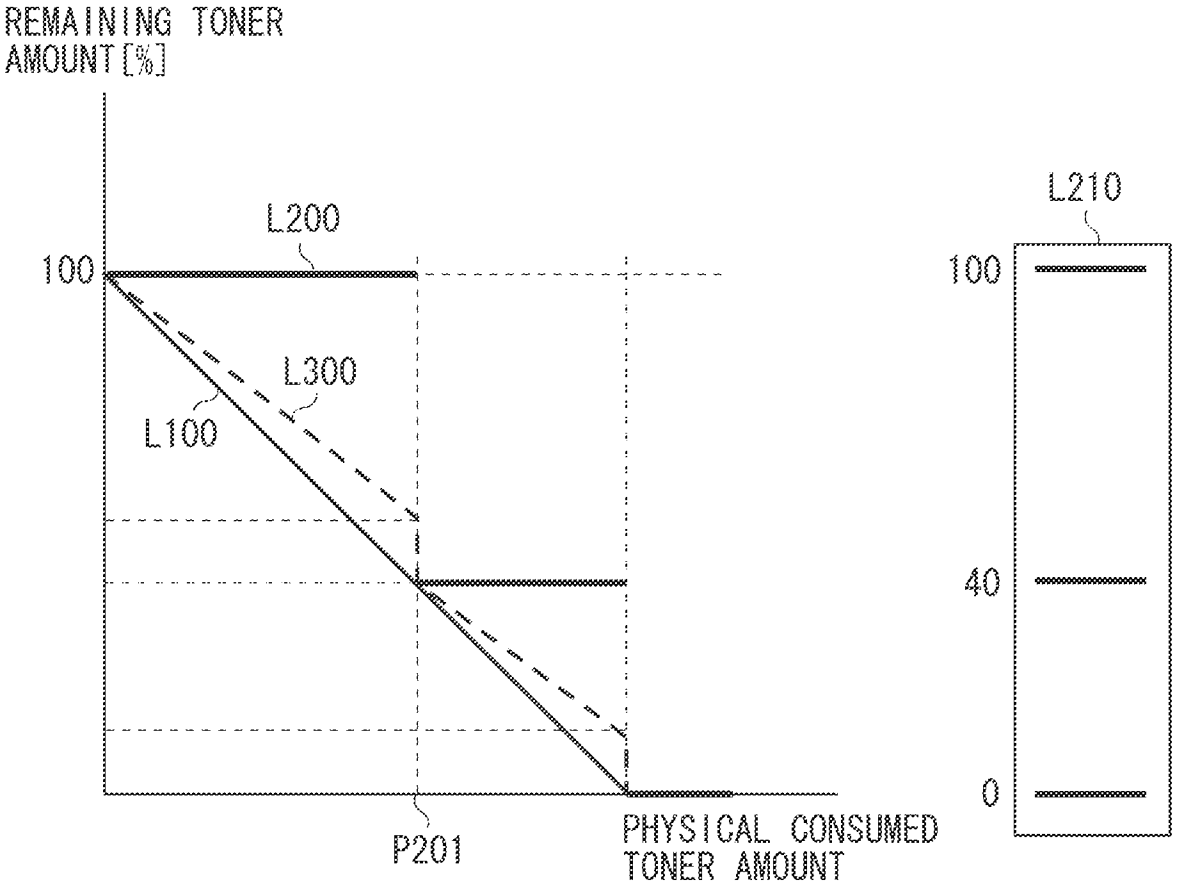
FIGS. 14A and 14B respectively illustrate shifts of a remaining toner amount (a third exemplary embodiment: a case where its current value shifts while being slightly higher than an actual remaining toner amount).

FIG. 14A illustrates a case where the present invention is not applied.

Figure 14B:
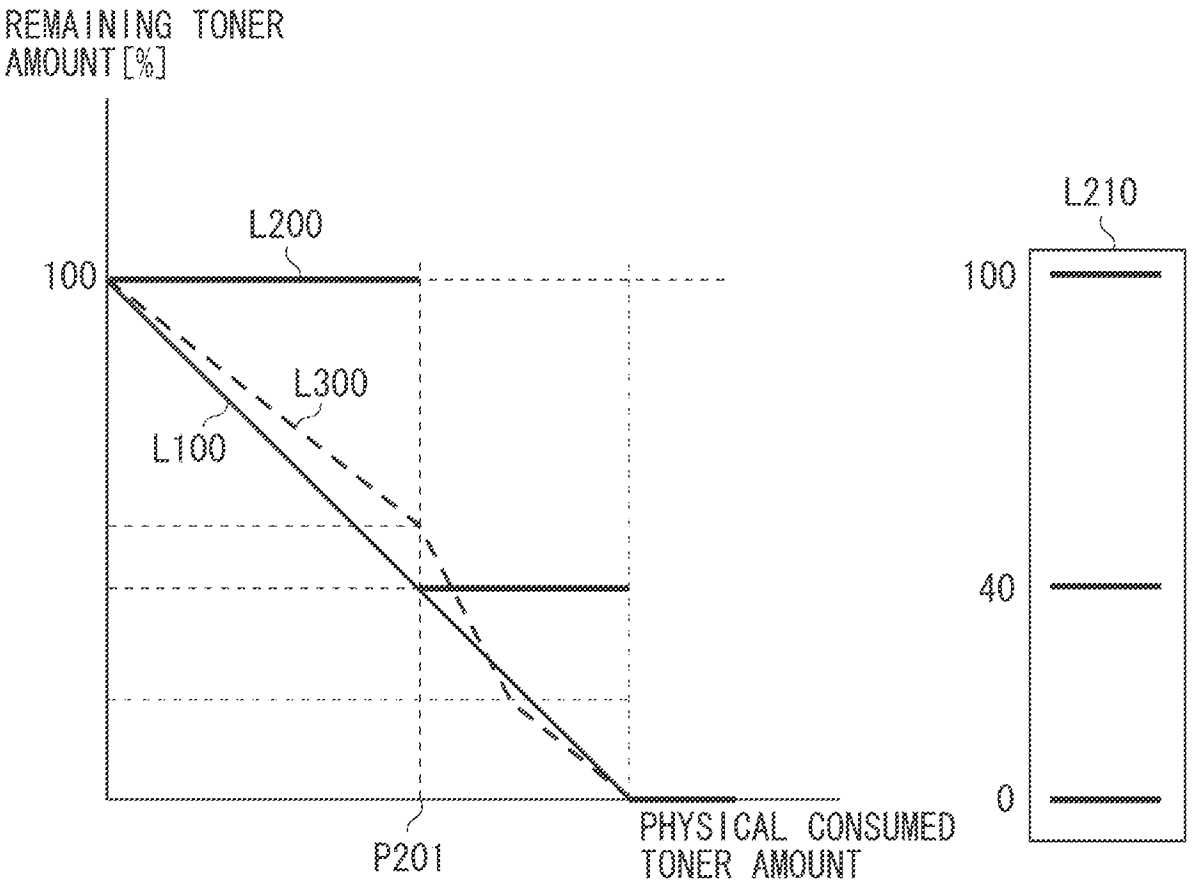

FIG. 14B illustrates a case where the present invention is applied.

In FIG. 14B, the current value can shift in the vicinity of the actual remaining toner amount without deviating toward a position higher than the actual remaining toner amount at a point P201 and beyond, as compared with that in FIG. 12B.

FIG. 15 illustrates a shift of a remaining toner amount (a third exemplary embodiment: a case where its current value shifts while being slightly lower than an actual remaining toner amount).

In FIG. 15, description of portions common to those illustrated in FIG. 13 is not repeated.

Figure 15A:
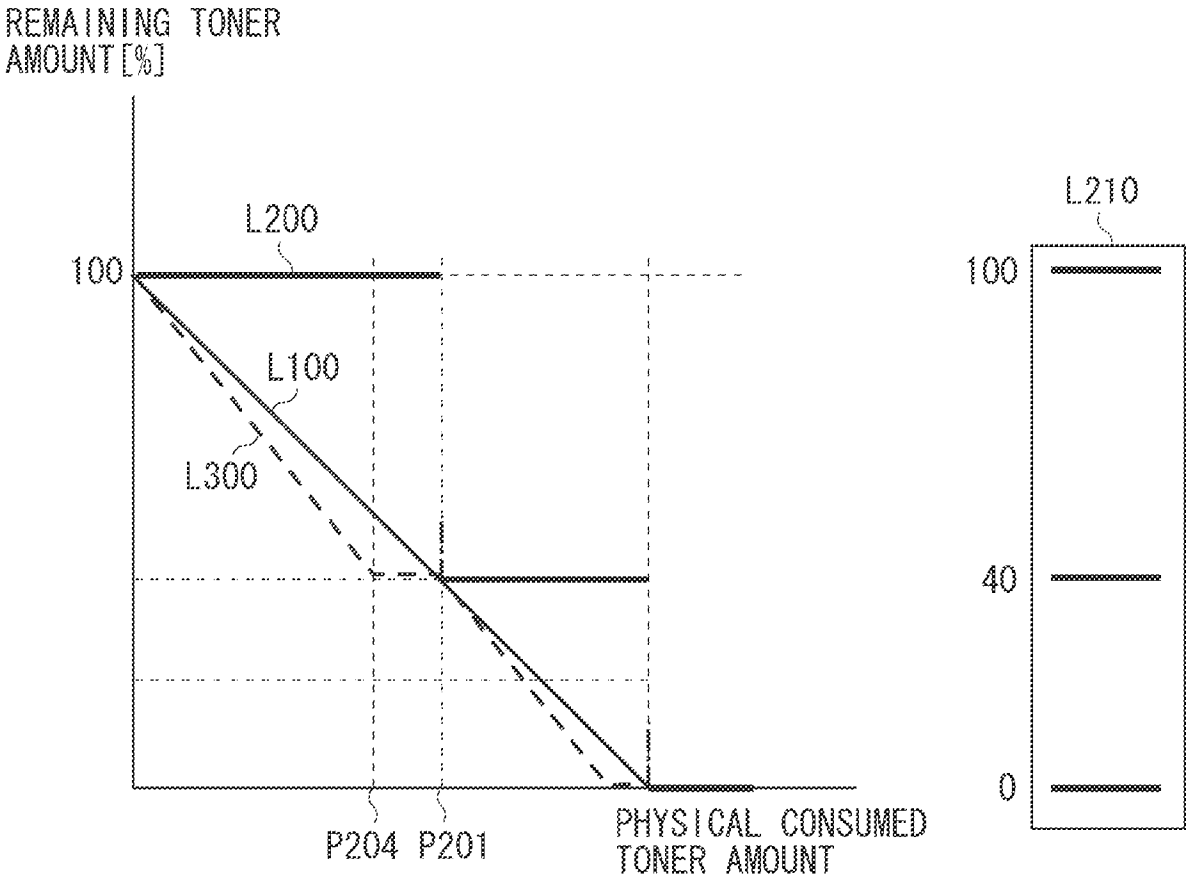
FIGS. 15A and 15B respectively illustrate shifts of a remaining toner amount (a third exemplary embodiment: a case where its current value shifts while being slightly lower than an actual remaining toner amount).

FIG. 15A illustrates a case where the present invention is not applied.

Figure 15B:
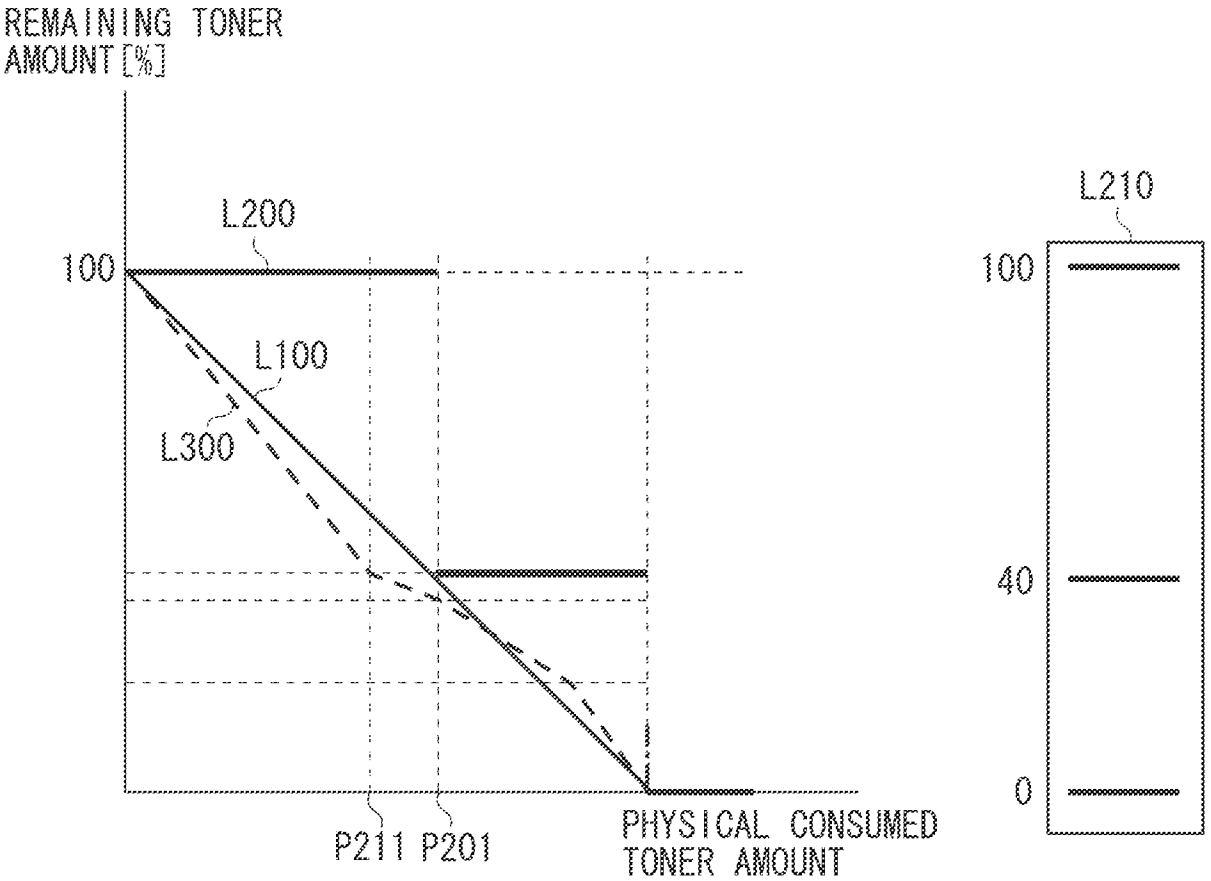

FIG. 15B illustrates a case where the present invention is applied.

In FIG. 15B, the current value can shift in the vicinity of the actual remaining toner amount without deviating toward a position lower than the actual remaining toner amount at a point P201 and beyond, as compared with that in FIG. 13B.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments.

This application claims the benefit of Japanese Patent Application No. 2013-180000 filed Aug. 30, 2013, which is hereby incorporated by reference herein in its entirety.

What is claimed is:

1. An image forming apparatus for executing print processing on a sheet using a recording material, the image forming apparatus comprising:

a processor and a memory storing instructions that, when executed by the processor, control:

an obtaining unit configured to discretely obtain a remaining amount of the recording material based on an output from a sensor, wherein the sensor detects the remaining amount of the recording material by at least one of a magnetic permeability detection method, a magnet method, a piezoelectric vibration method, and a transmissive light method;

a derivation unit configured to derive a consumption value of the recording material based on a dot count value of raster data for the printing processing, in a case where the image forming apparatus executes the print processing;

a predicting unit configured to predict the remaining amount of the recording material based on the consumption value of the recording material, wherein the predicting unit updates the predicted remaining amount of the recording material on at least one condition of executing the print processing;

a correcting unit configured to, upon condition that the predicted remaining amount of the recording material predicted by the predicting unit is larger than the obtained remaining amount of the recording material obtained by the obtaining unit, execute correction processing for increasing the consumption value of the recording material derived by the derivation unit by a predetermined amount, wherein the correcting unit executes the correction processing in a case where the condition on which the predicting unit updates the predicted remaining amount of the recording material is satisfied; and a notifying unit configured to notify a current remaining amount of the recording material based on the predicted remaining amount of the recording material.

2. The image forming apparatus according to claim 1, wherein the notifying unit displays the current remaining amount of the recording material on a display unit.

3. The image forming apparatus according to claim 1, wherein the recording material is toner.

4. The image forming apparatus according to claim 1, wherein the derivation unit obtains, based on the output from the sensor, the remaining amount of the recording material having reached a predetermined threshold value.

5. The image forming apparatus according to claim 1, wherein the predetermined amount is derived from a capacity of a cartridge storing the recording material.

6. The image forming apparatus according to claim 1, wherein the sensor outputs discrete values for the remaining amount of the recording material.

7. The image forming apparatus according to claim 1, wherein the predetermined amount corresponds to a predetermined percentage of an amount of recording material that a cartridge can store.

8. The image forming apparatus according to claim 1, wherein the predicting unit updates the predicted remaining amount of the recording material on at least one condition of executing the print processing on one page.

9. The image forming apparatus according to claim 1, wherein the predicting unit updates the predicted remaining amount of the recording material on at least one condition of executing the print processing corresponding to one print job.

10. A method of controlling an image forming apparatus that executes print processing on a sheet using a recording material, the method comprising:

discretely obtaining a remaining amount of the recording material based on an output from a sensor by detecting the remaining amount of the recording material by at least one of a magnetic permeability detection method, a magnet method, a piezoelectric vibration method, and a transmissive light method;

deriving a consumption value of the recording material based on a dot count value of raster data for the printing processing, in a case where the image forming apparatus executes the print processing;

predicting the remaining amount of the recording material based on the consumption value of the recording material and updating the predicted remaining amount of the recording material on at least one condition of executing the print processing;

upon condition that the predicted remaining amount of the recording material is larger than the obtained remaining amount of the recording material, executing correction processing for increasing the consumption value of the derived recording material by a predetermined amount, wherein the correction processing is executed in a case where the condition where updating the predicted remaining amount of the recording material is satisfied; and notifying a current remaining amount of the recording material based on the predicted remaining amount of the recording material.

11. A non-transitory computer readable storage medium storing instructions that, when executed by a computer, execute a control method for controlling an image forming apparatus executing print processing on a sheet using a recording material, the control method comprising:

discretely obtaining a remaining amount of the recording material based on an output from a sensor by detecting the remaining amount of the recording material by at least one of a magnetic permeability detection method, a magnet method, a piezoelectric vibration method, and a transmissive light method;

deriving a consumption value of the recording material based on a dot count value of raster data for the printing processing, in a case where the image forming apparatus executes the print processing;

predicting the remaining amount of the recording material based the consumption value of the recording material and updating the predicted remaining amount of the recording material on at least one condition of executing the print processing;

upon condition that the predicted remaining amount of the recording material is larger than the obtained remaining amount of the recording material, executing correction processing for increasing the consumption value of the derived recording material by a predetermined amount, wherein the correction processing is executed in a case where the condition where updating the predicted remaining amount of the recording material is satisfied; and notifying a current remaining amount of the recording material based on the predicted remaining amount of the recording material.

12. An image forming apparatus for executing print processing on a sheet using a recording material, the image forming apparatus comprising:

a processor and a memory storing instructions that, when executed by the processor, control:

an obtaining unit configured to discretely obtain a remaining amount of the recording material based on an output from a sensor, wherein the sensor detects the remaining amount of the recording material by at least one of a magnetic permeability detection method, a magnet method, a piezoelectric vibration method, and a transmissive light method;

a derivation unit configured to derive a consumption value of the recording material based on a dot count value of raster data for the printing processing, in a case where the image forming apparatus executes the print processing;

a predicting unit configured to predict the remaining amount of the recording material based on the consumption value of the recording material ,wherein the predicting unit updates the predicted remaining amount of the recording material on at least one condition of executing the print processing;

a determination unit configured to whether the predicted remaining amount of the recording material predicted by the prediction unit is larger than the obtained remaining amount of the recording material obtained by the obtaining unit, wherein in a case where the predicting unit updates the predicted remaining amount of the recording material, the predicting unit predicts the remaining amount of the recording material based on at least the consumption value and a predetermined offset amount, according to the determination unit having determined that the predicted remaining amount of the recording material predicted by the predicting unit is larger than the obtained remaining amount of the recording material obtained by the obtaining unit, and the predicting unit predicts the remaining amount of the recording material based on at least the consumption value and not based on the predetermined offset amount, according to the determination unit having determined that the predicted remaining amount of the recording material predicted by the predicting unit is not larger than the obtained remaining amount of the recording material obtained by the obtaining unit.

* * * * *